US007935222B2

(12) United States Patent
Brogdon et al.

(10) Patent No.: US 7,935,222 B2
(45) Date of Patent: May 3, 2011

(54) PAPERMAKING METHOD USING ONE OR MORE QUATERNIZED DIALKANOLAMINE FATTY ACID ESTER COMPOUNDS TO CONTROL OPACITY AND PAPER PRODUCT MADE THEREBY

(75) Inventors: Brian N. Brogdon, Marietta, GA (US); Gary M. Freeman, Macon, GA (US); Thomas C. Friel, Columbus, GA (US); Scott W. Rosencrance, Douglasville, GA (US)

(73) Assignee: Kemira Chemicals, Inc., Kennesaw, GA (US)

( * ) Notice: Subject to any disclaimer, the term of this patent is extended or adjusted under 35 U.S.C. 154(b) by 969 days.

(21) Appl. No.: 11/071,329

(22) Filed: Mar. 4, 2005

(65) Prior Publication Data

US 2006/0196624 A1 Sep. 7, 2006

(51) Int. Cl.
*D21H 21/14* (2006.01)
*D21H 21/26* (2006.01)
*D21H 17/14* (2006.01)

(52) U.S. Cl. ..... 162/179; 162/158; 162/181.1; 428/327

(58) Field of Classification Search ..... 162/109, 162/135, 158, 164.1, 164.6, 164.7, 166, 167, 162/168.1, 168.2, 179, 181.1, 181.2, 181.8; 428/323, 327
See application file for complete search history.

(56) References Cited

U.S. PATENT DOCUMENTS

| | | | | | |
|---|---|---|---|---|---|
| 2,739,091 | A | * | 3/1956 | Engstrom et al. | 156/181 |
| 3,554,862 | A | | 1/1971 | Hervey et al. | |
| 3,554,863 | A | | 1/1971 | Hervey et al. | |
| 3,619,351 | A | * | 11/1971 | Kolosh | 162/72 |
| 3,819,589 | A | * | 6/1974 | Fauke et al. | 525/327.6 |
| 4,000,077 | A | * | 12/1976 | Wixon | 510/522 |
| 4,540,521 | A | * | 9/1985 | Garst et al. | 558/38 |
| 4,871,483 | A | * | 10/1989 | Friel et al. | 554/56 |
| 4,874,466 | A | * | 10/1989 | Savino | 162/164.3 |
| 4,956,119 | A | * | 9/1990 | Friel et al. | 516/116 |
| 4,960,540 | A | * | 10/1990 | Friel et al. | 516/116 |
| 5,135,613 | A | * | 8/1992 | Waldmann | 162/199 |
| 5,217,576 | A | | 6/1993 | Van Phan | |
| 5,223,096 | A | | 6/1993 | Phan et al. | |
| 5,240,562 | A | | 8/1993 | Phan et al. | |
| 5,264,082 | A | | 11/1993 | Phan et al. | |
| 5,292,363 | A | | 3/1994 | Hutcheson | |
| 5,296,024 | A | | 3/1994 | Hutcheson | |
| 5,393,334 | A | | 2/1995 | Hutcheson | |
| 5,415,737 | A | | 5/1995 | Phan et al. | |
| 5,417,753 | A | | 5/1995 | Hutcheson | |
| 5,427,696 | A | | 6/1995 | Phan et al. | |
| 5,437,766 | A | | 8/1995 | Van Phan et al. | |
| 5,472,486 | A | | 12/1995 | Dragner et al. | |
| 5,478,387 | A | | 12/1995 | Dragner et al. | |
| 5,488,139 | A | | 1/1996 | Dragner et al. | |
| 5,494,555 | A | | 2/1996 | Dragner et al. | |
| 5,498,315 | A | | 3/1996 | Dragner et al. | |
| 5,611,890 | A | * | 3/1997 | Vinson et al. | 162/111 |
| 5,667,638 | A | * | 9/1997 | Dragner et al. | 162/158 |
| 5,672,249 | A | * | 9/1997 | Vinson et al. | 162/111 |
| 5,705,663 | A | * | 1/1998 | Brock et al. | 554/110 |
| 5,716,498 | A | * | 2/1998 | Jenny et al. | 162/158 |
| 5,730,839 | A | | 3/1998 | Wendt et al. | |
| 5,759,346 | A | * | 6/1998 | Vinson | 162/123 |
| 5,830,317 | A | * | 11/1998 | Vinson et al. | 162/125 |
| 5,851,352 | A | * | 12/1998 | Vinson et al. | 162/112 |
| 5,869,716 | A | * | 2/1999 | Subirana et al. | 554/114 |
| 5,935,383 | A | * | 8/1999 | Sun et al. | 162/158 |
| 5,958,185 | A | * | 9/1999 | Vinson et al. | 162/111 |
| 6,033,524 | A | * | 3/2000 | Pruszynski et al. | 162/165 |
| 6,037,315 | A | | 3/2000 | Franklin et al. | |
| 6,048,438 | A | * | 4/2000 | Rosencrance et al. | 162/158 |
| 6,156,117 | A | * | 12/2000 | Freeman et al. | 106/487 |
| 6,402,827 | B1 | * | 6/2002 | Freeman et al. | 106/487 |
| 6,419,791 | B1 | | 7/2002 | Dragner et al. | |
| 6,432,269 | B1 | | 8/2002 | Dragner et al. | |
| 6,458,343 | B1 | | 10/2002 | Zeman et al. | |
| 7,364,641 | B2 | * | 4/2008 | Chen et al. | 162/158 |
| 7,547,376 | B2 | * | 6/2009 | Satoh | 162/168.3 |
| 2004/0052746 | A1 | * | 3/2004 | Tamareselvy et al. | 424/70.11 |
| 2004/0087475 | A1 | * | 5/2004 | Jonke et al. | 510/515 |
| 2006/0196624 | A1 | * | 9/2006 | Brogdon et al. | 162/179 |
| 2007/0265469 | A1 | * | 11/2007 | Cowman et al. | 562/561 |
| 2009/0033704 | A1 | * | 2/2009 | Mori | 347/19 |

FOREIGN PATENT DOCUMENTS

| | | | | |
|---|---|---|---|---|
| CA | 2508688 | A1 | * | 9/2006 |
| JP | 2001081687 | A | * | 3/2001 |
| WO | WO 9511343 | A1 | * | 4/1995 |
| WO | WO 2006040332 | A1 | * | 4/2006 |

OTHER PUBLICATIONS

TAPPI publication TIS 0404-36, as revised 1992.

* cited by examiner

*Primary Examiner* — José A Fortuna
(74) *Attorney, Agent, or Firm* — Duane Morris LLP

(57) ABSTRACT

A method for making an opacity relevant grade paper or paperboard product, such as a communication type paper used for printing and writing applications, utilizes an effective amount of quaternized alkanolamine fatty acid ester compounds as an opacification aid to control the optical properties of the paper or paperboard product as a wet-end additive to a papermaking operation. Using the quaternized alkanolamine fatty acid ester compound can improve the opacity of the paper or paperboard product, maintain the opacity of the paper while reducing the use of other opacification aids, such as inorganic fillers and/or pigments, and allow for a reduction in paper grammage without a compromise in opacity. The improvements in paper optical properties are achieved without adversely affecting other characteristics of the paper product such as bulk value, tensile strength, tear index, and the like.

8 Claims, 3 Drawing Sheets

PAPERMAKING METHOD USING ONE OR MORE QUATERNIZED DIALKANOLAMINE FATTY ACID ESTER COMPOUNDS TO CONTROL OPACITY AND PAPER PRODUCT MADE THEREBY

FIELD OF THE INVENTION

The present invention is directed to a method of papermaking and a resultant paper or paperboard product made from the method, and in particular, to a method of papermaking that employs a quaternized alkanolamine fatty acid ester compound for improved control over the paper or paperboard product's optical properties.

BACKGROUND ART

Producing paper or paperboard on the industrial scale involves a complicated process whereby an aqueous papermaking slurry that comprises lignocellulosic-derived fibers (including virgin and/or recycled pulp fibers) is mixed with various process additives such as acids, bases, alums, sodium aluminate, sizing agents, dry strength additives, wet strength additives, filler/pigment materials (e.g., kaolin clay, titanium dioxide, calcium carbonate, etc.), retention aids, fiber defloculants, defoamers, drainage aids, optical brighteners, dyes, opacifiers, deposit control agents, antimicrobial agents, other specialty chemicals, etc.). The thus-treated pulp slurry is introduced to a process where the slurry is dewatered to form an initial wet paper web, which is generally pressed to further remove water and consolidate the wet paper web. This pressed wet paper web is dried and further processed to produce a sheet of paper or paperboard.

The optical properties of many paper and paperboard products, such as opacity and brightness, are one of the key criteria for judging its qualities to the papermaker, converting operations and ultimately to the end user such as the printers. These optical properties have to be balanced with other desired attributes in the sheet, primarily the sheet's basis weight, bulking value and its strength properties when subjected to various stresses (e.g., tensile, burst and tear strength). The balance of these optical and physical sheet properties is often governed by the paper or paperboard grade and the end use of the product.

Another important factor in the production of paper is the overall cost to produce a particular grade of paper or paperboard. One method for lowering the cost of making paper, particularly for grades having critical opacity and brightness requirements is to substitute part of the fiber furnish with inorganic filler/pigment materials. One exemplary category of paper products wherein opacity and brightness properties are critical to their functionality are communication papers (e.g., fine papers, newsprint, magazine, lightweight coated, etc.). These inorganic filler or pigment materials may include kaolin clay, calcined clay, ground calcium carbonate (GCC), precipitated calcium carbonate (PCC), talc, alumina trihydrate, amorphous silica & metal silicates and titanium dioxide, just to name a few. The addition of these filler/pigment additives can:

1) improve the formation and overall sheet structure by assisting in filling the void areas;

2) increase the opacity of the resulting sheet by increasing light scattering;

3) improve the physical characteristics of the sheet that assist with printing process—preventing the show through of print on one surface from the opposite side (as a consequence of the increased opacity they provide);

4) improve the brightness and whiteness properties of the sheet;

5) lower the overall cost of the sheet with a cheaper material than lignocellulosic fibers. However, in doing so they frequently increase the basis weight of the paper product; and 6) significantly bulk the sheet in the case of using highly structured mineral fillers such as calcined clays, structured silicas and the like.

The type of mineral filler or pigment that is used is often determined by the grade of paper that is being made, i.e., the degree of opacity and brightness, the cost of use, the resultant basis weight and strength properties required in the final paper product. High refractive index pigments, like titanium dioxide, are often used in printing and writing grades where high brightness and high opacity are needed. However, titanium dioxide is a very expensive inorganic pigment material and is often unsuitable for lower cost paper grades. Kaolin clay, calcined clay, PCC and GCC are lower cost alternatives to titanium dioxide, but all provide lower opacification power and brightness due to their lower refractive index. For the production of acid newsprint grades, calcined kaolin clay is often used due to its low cost to provide paper opacity and its improved compatibility versus PCC or GCC with acid wet-end papermaking systems. Typical addition levels that may be used of inorganic fillers or pigments, depending on the required opacification and paper grade being made can range from about 2 to 20% by weight.

For some paper grades, such as lightweight-coated (LWC) or directory grades, it is desired to have a sheet that has high opacification with a low basis weight (or grammage). Inorganic filler/pigments can be used in these applications; however, the drawback of inorganic filler/pigments is they provide opacification while disproportionately increasing the basis weight of the sheet because of their higher density values relative to cellulose fiber. Hence, it may not be possible to obtain the needed sheet opacity at the desired basis weight when using only inorganic mineral filler/pigments as the opacification additive.

Another drawback with inorganic filler/pigments is the amount that can be used. The addition of inorganic filler/pigments to the sheet, particularly at higher loadings, can cause a significant reduction of the sheet's strength properties. This is partially related to the interferences that the inorganic filler/pigments create with the fiber-to-fiber bonding, which is important in the development of paper strength. Yet, another drawback of inorganic filler/pigments is the abrasiveness nature of the filler/pigments. Inorganic filler/pigments have different degrees of abrasiveness (related to their crystal structure and hardness) and this abrasiveness can cause excess wear on the papermaking equipment, e.g., moving papermachine wires, pumping equipment, cutters, trimmer knives in the converting area, and the like.

The use of inorganic filler/pigments in papermaking usually requires these materials be made into an aqueous slurry dispersion, in which the filler/pigment slurry is applied and mixed with the aqueous fiber containing papermaking slurry prior to the papermachine. This also generally requires the inorganic filler/pigments to be made down into a workable slurry that can be stored, easily pumped and metered into the wet-end of the papermachine. Because the suspended, solid particles in these slurries have a tendency to settle, the filler/pigment slurries generally require constant agitation in their make-down tanks.

Another problem often associated with using inorganic filler/pigments in papermaking systems is their propensity to foul the papermachine wire and press felts. Fouling decreases the effectiveness of the papermachine to dewater the pulp slurry, thus requiring down time to clean and/or replace these papermachine equipment, and a resultant increase in the cost of producing the paper product.

As a result of the various problems identified above with using the inorganic filler/pigment based opacification aids, the papermaking industry is in need of new methods to improve and/or increase the opacity of various paper and paperboard grades whole optical properties are critical to their end-use functionality. Depending on the grade of paper to be made, the need for alternative opacification methods outside the use of mineral filler/pigments is being driven by the need to:

1) provide cost effective opacification to paper products without the aforementioned slurry handling, papermachine fouling and particle retention issues of inorganic fillers or pigments;
2) to provide equivalent opacity to current mineral or pigment filled sheets at a lower basis weight;
3) to improve the strength properties of high ash content grades of paper by replacing a portion of the mineral filler/pigment with an equivalent opacifying portion of quaternized alkanolamine fatty acid ester compound; and
4) to enable the production of higher opacity super calendered (SC) fine papers wherein a significant fraction of the opacifying benefits imparted by the opacification additive are maintained after calendering.

Part of the new opacification technology need is being driven, in the case of newsprint, by new multicolor printing technologies that require the newsprint to have better opacity and ink holdout. To date, the traditional approach to increasing newsprint opacity has been with the use of inorganic fillers (e.g., calcined kaolin clay, precipitated calcium carbonate (PCC), etc.). Another approach has been the use of organic dyes, with or without these other traditional aids. The brightness, whiteness, coloring and opacity of paper can be impacted through the addition organic dyes. Certain organic dyes, such as black and blue dyes, can be used to increase sheet opacity; however, the amount of dye that is used must be balanced against decreasing the brightness of the sheet or tinting of the sheet to an off-white color, which may be undesirable. These dyes, depending on their type, are very sensitive to the wet-end chemistry of the papermachine, and can be sensitive to variations in the papermachine fiber furnish. The effectiveness of these dyes can also be negatively influenced if microbiological agents are used in the papermaking slurry, particularly oxidizers like chlorine, chlorine dioxide, peracetic acid, etc. Other disadvantages of dyes, compared to most inorganic filler/pigments, is their relative high cost and their impact on wastewater effluent streams from papermills, which may require some additional treatment to properly dispose of them.

Various other efforts besides the addition of dyes or inorganic mineral filler/pigments to the wet-end, have been made in the prior art to better control the optical properties of paper during papermaking. One approach is disclosed in U.S. Pat. Nos. 5,292,363, 5,296,024, 5,393,334, and 5,417,753 to Hutcheson, wherein organic based opacification aids as fatty amides of alkanoldiamines are used in papermaking. These opacification aids are produced via the reaction of various fatty acids and various alkanoldiamines. More particularly, the products result from the reaction of stearic acid with aminoethylethanolamine (AEEA) to form mono- and distearamides of AEEA. These products are generally water insoluble and solid waxy materials with high melting points (>75° C.) in their 100% active form. For the fattyamides of alkanoldiamines to be used as a paper opacification aid, these products are made into aqueous emulsions to improve their dispersion characteristics in papermaking slurries. These emulsions contain several additional substances and usually require high shear mixing. These additional substances can include surfactant(s) and viscosity controlling agent(s). To obtain stable emulsions for these agents, it is typical to employ low concentrations (generally 9-13%) of the fattyamides of alkanoldiamines. While primarily an opacification aid, Hutcheson also teaches that the aids can improve paper brightness and paper size.

Improvements to the organic opacification aids taught by Hutcheson are found in U.S. Pat. Nos. 5,472,486, 5,478,387, 5,488,139, 5,494,555, and 5,498,315 to Drager and North. Therein, the opacification formulation of Hutchenson is improved by the addition of certain additives to the fattyamides of alkanoldiamines to increase both paper opacity and paper strength (e.g., "glyoxyl compounds/block resins). Drager and North also expand the types of fatty acids that can be used for making the fattyamides of alkanoldiamines, e.g., dimerized and trimerized tall oil fatty acids.

The prior art has also proposed quaternized versions of fattyamides of alkanoldiamines, see U.S. Pat. No. 5,667,638 to Dragner and North. In this patent, a quaternized version of a fattyamide of alkanoldiamine such as alkyl bis (alkyl amido alkyl)-2-hydroxy alkyl ammonium alkali salt can be added to papermaking slurries to improve paper opacification. These organic compounds are usually soft paste materials at room temperature as compared to the waxy fattyamides of alkanoldiamines of the prior art discussed above.

Dragner and North also teach in U.S. Pat. No. 6,419,791 mixtures of natural fatty oils with various amine-esters as opacification aids in papermaking. The resulting compounds are not easily dispersed in water and must be formulated into emulsions with the concerns and characteristics discussed above regarding the Hutchenson patents. These species generally are less effective than the fattyamides of alkanoldiamines taught by Hutchenson.

While a number of organic based opacification aids for opacity relevant paper grades have been proposed by the prior art, a need still exists for improved aids, particularly in light of the problems noted above regarding the use of inorganic filler/pigments, dyes, a variety of quaternized fattyamides and the like. Commercial feedback on some of the quaternized fattyamides currently being used in paper mills as opacification aids has indicated that their low solids content emulsion forms, the high application doses needed for yielding good opacity, the resultant loses in sheet strength properties and accompanying papermachine deposit issues are significant end-user issues that need improvement.

The present invention responds to this need via the discovery that quaternized alkanolamine fatty acid esters can be employed in papermaking operations to provide improved optical performance as compared to the prior art organic opacification aids currently being used, e.g., fatty amides of alkanoldiamines, quaternized versions of these fatty amides, and mixtures of fatty oils and various amine-esters. Use of the quaternized alkanolamine fatty acid esters, hereinafter more simply referred to as diester quats, also provides control over other aspects of the papermaking operation, e.g., decreasing inorganic filler/pigment amounts for the purposes of improving strength properties and/or decreasing paper grammage without a loss in opacity.

Quaternized alkanolamine fatty acid ester compounds are known and their use in papermaking methods has been proposed in U.S. Pat. Nos. 5,217,576, 5,223,096, 5,240,562, 5,264,082, 5,415,737, and 5,427,696. Each of these patents centers around modifying paper properties in tissue and towel paper grades. This prior art teaches the use of various quaternary ammonium chemical softening compounds, which includes quaternized alkanolamine fatty acid esters. While this art teaches the use of these compounds as softening aids which impart a soft feel and more adsorbent paper in the stated paper areas, there is absolutely no recognition of the use of the quaternized alkanolamine fatty acid esters as a wet-end papermaking additive for improving opacity. In fact, opacity is not even an issue with these grades, since tissue and towel paper grades are not commonly used or designed for use in end-use applications where show-through, printing and writing performance are, for example, important.

SUMMARY OF THE INVENTION

Accordingly, it is a first object of the present invention to control the optical properties of paper, such as brightness and opacity, by using a quaternized alkanolamine fatty acid ester compound.

Another object of the present invention is to improve the opacification properties of opacity relevant grades of paper or paperboard products by using the quaternized alkanolamine fatty acid ester compound as a wet-end additive to the papermaking slurry or a component used in making up the slurry. In generic terms, opacity relevant grades of paper can be defined as those paper or paperboard products wherein their opacification properties are critical to their end-use performance functionality (such as the opacity required in printing and writing grades which can be more broadly described as communication type papers).

A further object of the present invention is to decrease the loading of inorganic filler/pigments used in the wet-end during the papermaking process without incurring a loss of opacity through the use of the quaternized alkanolamine fatty acid ester compounds. In the process of reducing the filler/pigment loading in the paper product, the grammage (i.e., basis weight) of the resultant sheet can be reduced and/or its strength properties can be approved.

Still another object of the invention is to control paper grammage (i.e., basis weight) when making opacity relevant grades of paper or paperboard products using the quaternized alkanolamine fatty acid ester compounds. Paper grammage can be more readily controlled because of the very low specific gravity of these organic opacification aids as compared to the high specific gravity of inorganic mineral filler/pigments. In addition, the paper grammage can be reduced while maintaining sheet opacity by also replacing quantities of both inorganic filler/pigments and fiber with small addition levels of the organic opacification aids.

Still another object of the invention is to provide convenient as well as cost effective opacification of paper products without the extensive use of inorganic filler/pigments that have various slurry handling, papermachine fouling and particle retention issues when applied in dispersed slurry form as a wet-end papermaking additive.

Yet another object of the invention is to provide an organic opacification aid to be used as a wet-end papermaking additive that has no significant deleterious effects on other important sheet characteristics such as brightness or mechanical properties.

Still another object of the invention is to provide an organic opacification aid to be used as a wet-end papermaking additive that can increase opacity without affecting the paper's bulk and accordingly whose opacifying benefits to the sheet are still maintained to a significant degree even after the paper product is calendered.

One other object of the invention is a finished paper or paperboard product that is an opacity relevant grade of paper that is made from a papermaking operation that employs a quaternized alkanolamine fatty acid ester compound for control of the paper product's optical properties (such as opacity and brightness). Opacity relevant grades of paper are paper or paperboard products whose opacification properties are critical to their end-use performance functionality. Communication type papers, such as those used in printing and writing applications, are but one general example. On the basis of paper grade classifications, as defined in TAPPI publication TIS 0404-36, as revised in 1992, some of the grades wherein opacity is typically important to end-use performance functionality include:

1) Uncoated Groundwood: About 80% of the uncoated groundwood paper that's produced is newsprint. However, also included in this category are directory, computer paper, catalog, and advertising supplements (rotogravure).
2) Coated Groundwood: Paper grades that are include in this category are letterpress, offset, light-weight coated (LWC) and magazine.
3) Uncoated Wood-Free: Typical end uses for the paper grades included in this category are office papers (forms, copy, bond, tablet, cover, and envelope), carbonless, and printing papers (offset, cover, text). This category is also commonly referred to as printing, writing, and book papers.
4) Coated Wood-Free: The paper in this category can be coated on either one side or both sides. Typical end uses for the grades in this category include magazines, books and commercial printing.
5) Kraft Paper: The paper of relevance in this category will employ bleached kraft at grammages <100 g/m$^2$. End-use applications for these papers include areas such as wrapping as well as bag & sack.
6) Paperboard—Bleached & Unbleached: Some of the relevant application areas in this category, with respect to the organic opacification aids of the current invention, could include items like printing boards, computer cards and index cards as well as whitetop linerboard.

Various other specialty papers requiring opacification that do not fall into one of the TAPPI grade categories listed above include items like bible papers, cover sheets for dining tables and medical exam tables, paper surgical gowns and the like.

In comparison, some examples of paper grades where opacification is not critical to the paper product's end-use performance are recycled paperboard for items like corrugating medium and folding boxboard as well as the tissue paper grades, such as facial and bathroom tissue products, toweling, napkins, and the like. For the tissue and toweling products the key performance parameters are instead features like softness, bulk and absorbency. Opacification aids are therefore not used in these paper application areas.

Other objects and advantages will become apparent as a result of the ensuing description of the invention.

The present invention is an improvement in the methods of making opacity relevant grades of paper and paperboard products wherein one or more opacification aids are added to a papermaking slurry or components making up the slurry as part of the papermaking operation. The invention entails adding an effective amount of one or more quaternized alkanolamine fatty acid ester compounds to the papermaking slurry and/or one or more components used in making up the papermaking slurry to control the resultant optical properties, such as brightness and opacity, in those grades of paper whose end-use performance functionality is dependent on having good opacity properties. Particularly, the opacity of the paper or paperboard product can be improved as compared to the use of other prior art opacification aids, or opacity and/or other properties can be maintained in concert with a reduction in other additives such as inorganic filler/pigments. Paper grammage can also be decreased when using the quaternized alkanolamine fatty acid ester compound as part of the papermaking operation because in being organic based compounds their specific gravity is much less that for inorganic based fillers or pigments. Also, in replacing a portion of the inorganic filler/pigment being used in high ash content papers with the organic opacification aid of this invention the strength properties of the paper product can also be improved.

The quaternized alkanolamine fatty acid ester compound can be used in either a high actives basis undiluted form or can be used in a diluted form. Preferably, the compound is used as a liquid in either the 100% actives form or in the diluted form, but some compositional variants of the compound can be solids or pastes at room temperature and can be accordingly used with the requisite heating for melting or softening prior to its wet-end addition to the papermaking operation. If diluted, any type of compatible diluent could be used. Examples of diluents include, but are not limited to, lower alcohols of $C_1$-$C_6$, glycols, glacial acetic acid, mono-, di- and tri-glycerides, water and mixtures thereof.

While some quaternized alkanolamine fatty acid ester compounds are commercially available, they can be synthesized by reacting a fatty acid with an alkanol amine to produce a fatty acid ester alkanol amine and quaternizing the fatty acid ester alkanol amine using an alkylating agent to form the quaternized alkanolamine fatty acid ester compound. While any type of fatty acid is believed adaptable for the synthesizing step, fatty acids of the $C_6$-$C_{24}$ type are preferred, and they can include substituted or unsubstituted types, and mixtures thereof, or linear or branched types, and mixtures thereof, or saturated, and/or unsaturated/polyunsaturated types, and mixtures thereof, or mixtures of two or more of the above-listed types. The fatty acids can be derived from virtually any source which can be one of tallow, soy, palm, palm kernel, rapeseed, canola, tall oil, lard and mixtures thereof. The alkanol amines used in the synthesizing step can be of any known type, with preferred ones including trimethanolamine, triethanolamine, tripropanolamine, propanol diethanolamine, ethanol diisopropanolamine, triisopropanol amine, diethanolisopropanol amine, ethanoldiisobutanolamine, diethanolisobutanol amine, methyldiethanolamine (MDEA), methyldimethanolamine, ethyldiethanolamine and mixtures thereof. The alkylating agent of the synthesizing step can be of any known type, with preferred agents including dimethyl sulfate, diethyl sulfate, methyl chloride, ethyl chloride, dimethyl carbonate, diethyl carbonate, dimethyl phosponate and mixtures thereof.

One or more other filler/pigments such as kaolin clay, calcined clay, ground calcium carbonate, precipitated calcium carbonate, talc, alumina trihydrate, amorphous silica & metal silicates and titanium dioxide can be added to the papermaking slurry for control of optical properties.

When adding the effective amount of the quaternized alkanolamine fatty acid ester compound in combination with another filler or pigment, such as PCC or titanium oxide, the opacity of the finished paper or paperboard product is further increased as compared to that obtained when using the filler or pigment alone. Alternatively, the opacity that is obtained when normally using a set amount of filler or pigment is maintained when using a combination of the quaternized alkanolamine fatty acid ester compounds and lower levels of the filler/pigment. The accompanying benefit realized from replacing the inorganic filler/pigment with an equivalent opacifying amount of the quaternized alkanolamine fatty acid ester compound is a reduction in sheet grammage (basis weight) given the lower specific gravity of the organic compound as compared to the specific gravity of the inorganic filler or pigment. In high ash content papers, this partial replacement of inorganic pigment/filler with the organic compound can also help to improve the strength properties of the finished paper product. The effective amount of the one or more quaternized alkanolamine fatty acid ester compounds further comprises up to about 100 pounds per ton of bone dry solids in the papermaking slurry, and more preferred values include up to about 5, 10, 15, 20, and 25 pounds per ton of the dry solids of the slurry.

The invention also entails an improved opacity relevant paper or paperboard product, such as but not limited to the communication type printing and writing grade papers previously discussed, made from the method described above. This paper product has enhanced opacity as compared to paper products using the prior art opacification aids, and accomplishes this goal without loss in other characteristics of the paper product such as brightness, bulk value, tear index and the like. Various opacity relevant paper or paperboard products that can be made according to the invention include, but are not limited to, printing & writing grades, newsprint, magazine grades, fine paper grades, coated and/or uncoated book grades, directory grades, bond grades, bible grades, bristol grades, offset printing grades, super-calendered grades, light-weight grades, light-weight coated grades, mailers, envelopes, advertising supplements, specialty writing stock, whitetop linerboard, index cards, printing boards and cover sheets for dining tables and the like. The paper product can also contain inorganic fillers or pigments such as kaolin clay, calcined clay, ground calcium carbonate, precipitated calcium carbonate, talc, alumina trihydrate, amorphous silica & metal silicates and titanium dioxide, and mixtures thereof. Other known wet-end additives such as acids, bases, alums, sodium aluminate, sizing agents, dry strength additives, wet strength additives, fillers, retention aids, fiber defloculants, defoamers, drainage aids, optical brighteners, dyes, opacifiers, deposit control agents, and antimicrobial agents, and mixtures thereof as they would be normally used in a papermaking operation can also form part of the paper or paperboard product.

DESCRIPTION OF THE PREFERRED EMBODIMENTS

Figure 1:
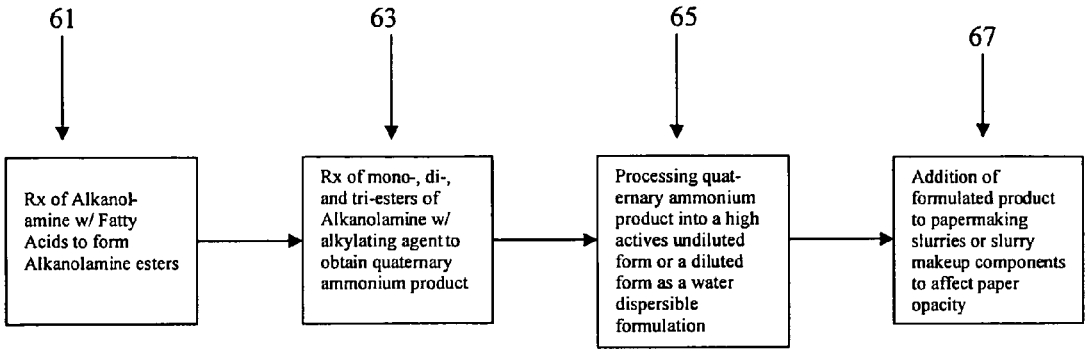
FIG. 1 is a flow chart showing an exemplary method of making a quaternized alkanolamine fatty acid ester compound for use in the inventive method.

The present invention offers significant and unexpected improvements in the control of optical properties during papermaking operations. More particularly, the use of quaternized alkanolamine fatty acid ester compounds as part of the papermaking process produces an opacity relevant paper or paperboard product that has improved opacity as compared to paper products using known opacification aids, e.g., alkanolamine fatty acid ester compounds and the fattyamides of alkanoldiamines, when compared on their active opacification components on an equivalent addition level basis. The improvements in sheet opacity occur upon adding the quaternized alkanolamine fatty acid ester compound as a wet-end additive without deleteriously affecting the brightness, bulk and strength properties of the resulting sheet of paper.

The application of quaternized alkanolamine fatty acid ester compounds to papermaking slurries prior to paper formation can not only be used to increase paper opacity but can also be employed to decrease the amount of inorganic filler/pigment utilized while maintaining a target opacity. Further yet, because the specific gravity of the quaternized alkanolamine fatty acid ester compounds are similar to the specific gravity of cellulose and much less than the specific gravity of typical inorganic filler/pigment opacifiers, a paper product can be produced at a target opacity but with a lower basis weight or paper grammage which is very desirable in many grades of paper like LWC, mailers, and the like. Furthermore, the addition of the quaternized alkanolamine fatty acid ester compounds to the papermaking slurry does not adversely affect the resultant mechanical properties of the paper, and characteristics such as tensile index, tear strength, burst index and bulk value are not compromised.

Another attribute of the present invention is that quaternized alkanolamine fatty acid ester compounds can be produced at high active content (>90%). Additive products for the wet-end papermaking process containing a high actives content of the quaternized alkanolamine fatty acid ester compound can be formulated into homogenous, clear, pumpable liquids that are readily dispersible in water. The preparation of low solids content emulsion products is therefore not required when using the quaternized alkanolamine fatty acid ester compounds of this invention. The highly concentrated but liquid product formulations of this invention can therefore be transported to the papermaking site and then easily applied at strategic point(s) in the papermaking process prior to sheet formation.

By the addition of the quaternized alkanolamine fatty acid ester compounds to a papermaking furnish or slurry, improved optical properties, such as brightness and opacity, for the paper product are obtained. As used herein, the term papermaking slurry or furnish is meant as a suspension of cellulosic fibers used to form a cellulosic paper product such as a sheet.

Opacity relevant grades of paper are defined as paper or paperboard products whose opacification properties (e.g., Tappi opacity, TAPPI or ISO brightness, scattering coefficients and prevention of show-through when printed on or written upon) when considered either alone or in combination with other non-opacity paper-related sheet properties, e.g., bulk, tear, burst strength, tensile strength, grammage, etc., are critical to the product's end-use performance functionality. These opacification properties are evaluated when selecting, offering for sale or selling, or developing a particular paper or paperboard product for a given end-use application. For example, a buyer of fine grade paper may require that the product have a minimum opacity prior to purchase, thus making this product opacity relevant. Alternatively, opacity may be combined with a mechanical property such as tensile strength or paper grammage as part of an evaluation, again defining an opacity relevant paper product. In contrast, paper or paperboard products intended for use in a given application wherein opacity is irrelevant or would not be evaluated as part of the intended use would not be considered to be an opacity relevant grade of paper or paper product. Tissue or towel grades are one example of these types of products, wherein non-opacity properties such as softness, bulk, absorbency, and the like are critical for their end use functionality. Another example would be corrugating medium or folding boxboard. These paperboard products are evaluated on the basis of the properties of weight, strength (such as burst, tensile and tear), their ability to be glued, coefficient of friction, ink acceptance with respect to subsequent print definition quality and/or barrier resistance to water, oil and grease, and the like and therefore, they would also not be considered to be an opacity relevant paper product.

The opacity relevant paper or paperboard product may be a fine paper (which can be derived from virgin-fiber based material, recycle-fiber based material, or a combination thereof), a board (which can be derived from virgin-fiber based material, recycle-fiber based material such as test liner or corrugated material, or combinations thereof), or newsprint (which can be derived from magazine furnishes and/or virgin-fiber based and/or recycle-fiber based materials), or other cellulosic materials. The paper product may also contain other additives such as inorganic fillers, opacifying pigments, brighteners, sizing agents, and other materials normally used in the production of paper and paperboard products whose end-use performance suitability is dependent on its optical properties. Many of these opacity relevant paper or paperboard products are those that have the necessary level of wet-end additives, particularly opacifiers, to allow the paper or paperboard product to be used, for example, in communication media applications wherein the use of the paper product is such that printing, writing or other markings using various media, or combinations thereof, on one side bleeding through or seen on the other side of the paper product would render the product ineffective for its intended communication media use. Other types of paper products needing opacity outside those targeted for communication media use are known to those skilled in the art and include but are not limited to paper items like whitetop linerboard, cover sheets for dining and medical exam tables, surgical gowns, etc. More specific examples of various opacity-relevant grades of paper and paperboard products include, but are not limited to, printing & writing grades, newsprint, magazine, fine paper, book grades (coated and/or uncoated), directory grades (typically used in phone books), bond grades, bible papers, Bristol grades, offset printing grades (uncoated book), super-calendered grades (SC), light-weight (LW) grades, light-weight coated (LWC) grades, advertising supplements, index cards, printing boards and the like. Other grades having increased opacity at lower basis weights include mailers, envelopes, and specialty writing stock.

Grades not considered to be opacity relevant paper or paperboard products include tissue and toweling, sanitary, napkins, and recycled paperboard for corrugating medium and folding boxboard or other grades where opacity is not an important performance parameter and accordingly not considered a benefit for the targeted end-use application of the paper product. It should be understood that the above list of opacity relevant grades of paper and paperboard products is not exhaustive and that other grades that require sufficient opacity for the paper or paperboard product to function in its target end-use application are believed to be candidates for the invention.

Besides providing improvements over other organic opacification aids such as fattyamides of alkanoldiamines and alkyl bis (alkyl amido alkyl)-2-hydroxy alkyl ammonium, the quaternized alkanolamine fatty acid ester compounds also demonstrate favorable ecotoxicological characteristics and biodegradability.

The invention is described in more detail below in terms of the manner in which the quaternized alkanolamine fatty acid ester compounds are made, and more specific examples of quaternized alkanolamine fatty acid ester compounds. Also described below is the manner in which the quaternized alkanolamine fatty acid ester compounds are used in papermaking operations. Lastly, comparative experimental evidence is presented to demonstrate that the use of the quaternized alkanolamine fatty acid ester compounds provides: (1) improved opacity over prior art organic opacification aids, (2) no loss in other properties of the sheet product made using the quaternized alkanolamine fatty acid ester compounds, (3) the ability to replace other inorganic filler/pigments without incurring a loss in paper opacity, (4) the ability to reduce the total grammage of the paper product by replacing either the inorganic filler/pigments or fiber with some small quantities of the opacification aid while maintaining the sheet's opacity, and (5) the ability to maintain opacity improvement benefits derived from the use of the quaternized alkanolamine fatty acid ester compounds as wet-end additives even after calendering of the paper product.

Another trait of the use of the diester quats in papermaking operations is the ability to maintain or improve strength properties in high ash content papers by replacing a portion of the inorganic filler/pigment being used in the papers with the organic opacification aid of the invention. High loadings of inorganic fillers or pigments typically decrease internal Scott bond as a consequence of the fiber debonding their incorporation causes. Further, it has been unexpectedly shown that the organic opacification aids of this invention enable the production of higher opacity super calendered (SC) papers wherein a significant fraction of the opacifying benefits imparted by the additive, when used in the wet-end, are still maintained after calendering the paper. This after-calendering performance feature is in contrast to other wet-end papermaking additives, such as traditional debonders and bulking aids, whose ancillary opacification benefits derived from bulking up the sheet are largely lost upon super-calendering. The debonders and bulking aids known in the art are believed to incorporate more air micro-voids in the sheet and these air voids are apparently easily compressed under typical calendering conditions. The after-calendering opacity performance of the quaternized alkanolamine fatty acid ester compounds therefore suggests an entirely different wet-end mechanism is operative versus that observed for the known debonders and bulking aids. While the operative wet-end performance mechanism for the quaternized alkanolamine fatty acid ester compounds is not well understood at this point in time, this lack of mechanistic understanding does not limit the disclosed utility of these compounds as good opacification aids for various paper and paperboard products needing opacity.

Quaternized Alkanolamine Fatty Acid Ester Compounds and Methods of Making

The additive is synthesized by reacting fatty acids of various chain lengths with alkanol amines of various substitutions. The mole ratio of the fatty acid and the alkanol amine can vary. The species are typically condensed in a nitrogen purged reactor at temperatures around 155° C. until a target acid value is obtained. The resulting fatty acid ester alkanol amine can then be quaternized. The quaternization reaction typically is initiated around 70° C. and progresses for a few hours typically. The resulting materials can range from liquids to pastes as a function of the initial reactants and degree of quaternization. If the material is a very viscous liquid or paste, the product can be formulated with various compatible solvents, such as but not limited to isopropanol or propylene glycol, at levels of about 5% -30% by weight of the diluted formulation in order to obtain homogenous relatively low viscosity liquids.

FIG. 1 is a flow chart showing an exemplary method of making the quaternized alkanolamine fatty acid ester compound in sequence. The preparation of the additives involves three primary steps:

1) forming the alkanolamine esters, identified as step 61 in FIG. 1;

2) quaternizing the alkanolamine esters as step 63; and 3) formulating the resulting species into a high actives water dispersible product as step 65; and 4) using the quaternized alkanolamine fatty acid ester compounds in a papermaking operation as step 67.

A more detailed description of steps 61, 63, and 65 is listed below.

Forming Alkanolamine Esters:

The alkanolamine can be any type but it is preferred that it is selected from a group consisting of trimethanolamine, triethanolamine (TEA), tripropanolamine, propanol diethanolamine, ethanol diisopropanolamine, triisopropanol amine, diethanolisopropanol amine, ethanoldiisobutanolamine, diethanolisobutanol amine, methyldiethanolamine(MDEA), methyldimethanolamine, ethyldiethanolamine or mixtures thereof.

Similar to the choice of alkanolamines, it is believe that virtually any fatty acids can be employed in the synthesization process. One example of a preferred fatty acid are the $C_6$-$C_{24}$ types, and the fatty acids can also be substituted or unsubstituted, and mixtures thereof. Alternatively, they can be linear or branched, and mixtures thereof, or be composed of saturated, unsaturated/polyunsaturated components, and mixtures thereof.

The fatty acid can be derived from natural products (but not limited to the following): tallow, soy, palm, palm kernel, rapeseed, canola, tall oil, lard or mixtures thereof.

In forming the esters according to step 61, the fatty acid can be reacted with trialkanolamine (e.g., TEA) in a molar ratio of 1.4 to 2.5, respectively, or dialkanolamine (e.g., MDEA) in a molar ratio of 1.4 to 2.0. Within the scope of these alkanolamine/fatty acid ratios, it is understood that various mixtures of TEA and MDEA can be used together as the alkanolamine source in forming the ester intermediates useful for subsequent quaternization to produce the organic opacification aids of this invention.

The fatty acid is not limited to mono-fatty acids but also could include dimerized acids ($C_{18}$-$C_{54}$) derived from polyunsaturated mono-fatty acids and mixtures thereof. Similar to the mono-fatty acids, the esters can be formed by reacting the dimerized fatty acid with trialkanolamine (e.g., TEA) in molar ratios between 0.75 and 2, respectively, or with dialkanolamine (e.g., MDEA) in a molar ratio between 0.75 to 2.0, respectively. Within the scope of these alkanolamine/fatty acid ratios, it is understood that various mixtures of TEA and MDEA can be used together as the alkanolamine source in forming the ester intermediates useful for subsequent quaternization to produce the organic opacification aids of this invention.

Forming Quaternary Ammonium Product

Referring to step 63, the resulting mixture distribution of mono-, di-, and tri-esters of the above alkanolamines are reacted with an alkylating agent. The alkylating agent can be any known type for this type of synthesis with preferred agents selected from the group consisting of dimethyl sulfate, diethyl sulfate, methyl chloride, ethyl chloride, dimethyl carbonate, diethyl carbonate, dimethyl phosponate or mixtures thereof. The alkanolamine esters are preferably reacted with the alkylating agent in a molar ratio of 1:0.75 to 1:1, respectively.

The alkylating reaction can be carried out in bulk or employ a solvent, e.g. lower alcohols of $C_1$-$C_6$ (e.g., isopropanol). Examples of other solvents include mono-, di- and tri-glycerides, fatty acids, glycols and mixtures thereof, although virtually any compatible solvent could be employed as part of the alkylating reaction.

At the end of the reaction, the resulting product might have traces of unreacted alkylating agent, which may be neutralized by the addition ammonia, glycine or monoethanolamine.

It should be understood that the methods described above for making the quaternized alkanolamine fatty acid ester compounds are exemplary, and the various parameters may vary as would be known to those of skill in the art. Furthermore and as detailed below, the quaternized alkanolamine fatty acid ester compounds are also commercially available, e.g., Example 12-INV, and either commercially available compounds or ones synthesized as detailed above are applicable for use in a papermaking operation as described below.

Processing Quaternary Ammonium Product(s) into a High Actives Water Dispersible Formulation The resulting quaternary ammonium products described above can be used as is without further processing as a high actives product, i.e., an undiluted form. Alternatively, the resulting quaternary ammonium product can be made into a liquid stabilized formulation by blending with an appropriate diluent to yield a diluted form of the product. Examples of the diluent include, but are not limited to, lower alcohols of $C_1$-$C_6$ (e.g., isopropanol), glycols (ethylene glycol, propylene glycol), glacial acetic acid, mono-, di- and tri-glycerides, water and mixtures thereof.

The blending of diluent with the quaternary ammonium product(s) can be at levels of about 30 to 5% diluent with the balance as the quaternary ammonium product to form a very high actives formulated product. Lower actives content blends using diluent can also be made and utilized wherein the levels of diluent utilized range from greater than 30% to about 95% by weight. Likewise, a formulated aqueous based product can be made which contains 15 to 40% quaternary ammonium product blended with water using good mixing that has been pH adjusted to 2.5 to 3.5 with an inorganic (e.g., HCl) or organic acid (e.g., acetic acid) and has 20 to 20,000 ppm of an inorganic viscosity control agent, such as halides of the Group IA and IIA metals of the Periodic Chart (e.g., $CaCl_2$). The art for formulating these types of products is known as disclosed in U.S. Pat. No. 6,037,315 to Franklin et al., which is herein incorporated by reference in its entirety. As such, a further description of this aspect of the invention is not deemed necessary for an understanding thereof.

The formulated quaternary ammonium product(s) is then applied to the papermaking slurry as described below.

Use of the Quaternized Alkanolamine Fatty Acid Ester Compound in Papermaking

As noted above, the invention entails the use of the quaternized alkanolamine fatty acid ester compounds discussed above as organic opacification aids in a papermaking operation wherein the operation uses the organic opacification aids to produce opacity relevant grades of paper or paperboard products, such as but not limited to communication grades for printing and writing. For example, in grades for printing applications, the resultant paper product should have sufficient opacity so that it can be printed on both sides without the printing from one side being seen from the other side.

The quaternized alkanolamine fatty acid ester compound is added to a papermaking operation in an effective amount to one or more sites or locations in the papermaking operation and to either the papermaking slurry or one or more components making up the slurry for the purpose of controlling the optical properties, namely brightness and opacity, of the resulting paper or paperboard product being made. The effective amount is considered to be that amount that either improves the opacity of the paper or paperboard product, or maintains the opacity of the paper or paperboard product should the amounts of other wet-end additives, such as fillers, pigments, dyes and the like, being used in the papermaking operation be changed or should the characteristics such as paper grammage be altered when utilizing the quaternized alkanolamine fatty acid ester compounds in the papermaking operation.

Figure 2:
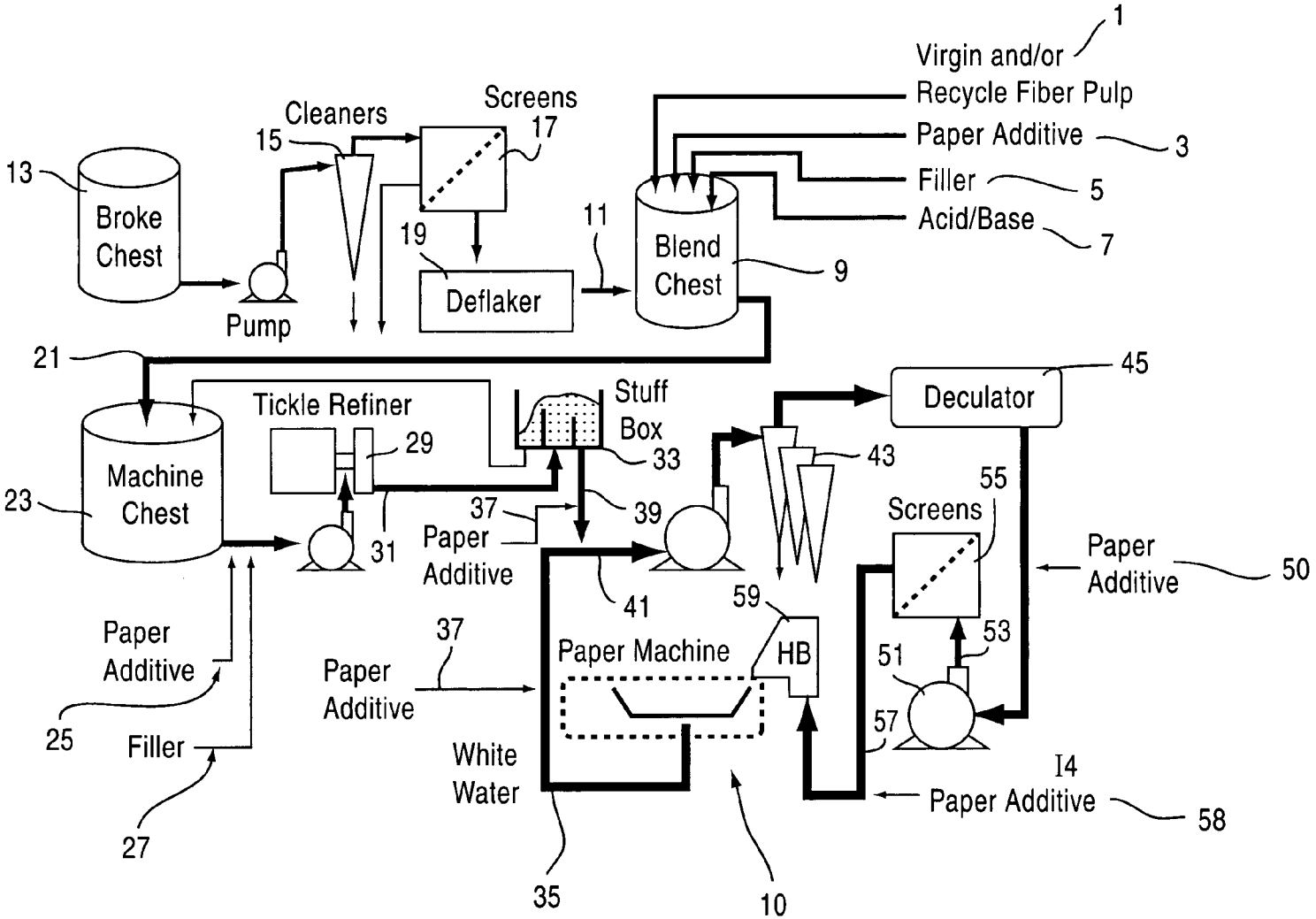
FIG. 2 is an exemplary schematic of a papermaking operation showing various locations for adding quaternized alkanolamine fatty acid ester compounds for optical property control.

FIG. 2 shows an exemplary schematic of a papermaking operation which identifies various points where the quaternized alkanolamine fatty acid ester compounds could be added to the papermaking slurry, including the preparation of a final papermaking slurry approaching the papermachine 10. These points include any sites wherein a paper additive, filler, acid/base or pulp are added. As noted above, the quaternized alkanolamine fatty acid ester compound could be mixed with one of the components such as the filler/pigments or other wet-end additives prior to adding to the slurry. In FIG. 2, an initial papermaking slurry is made by blending lignocellulosic fiber pulp 1, which can be virgin and/or recycled fibers derived from a pulping process, with certain wet-end papermaking additives 3, inorganic fillers or pigments 5, and other chemicals, e.g., acids/bases 7, to adjust the pH, in the blend chest 9. Also added at the blend chest 9 is re-pulped waste paper/pulp that results from the actual papermaking operation, often referred to as broke 11, which has been pumped from the broke chest 13, and fed through cleaners 15, screens 17, and a deflaker 19. All of the components 1, 3, 5, 7, and 11 are carefully metered into the blend chest 9 at the correct proportions for a given paper grade and agitated to have an evenly mixed papermaking base slurry/stock. The blend chest stock 21 is transferred to a machine chest 23, which serves as a holding chest to ultimately meter in the raw blended pulp to the papermaking machine 10. From the machine chest 23, other papermaking additives 25 and fillers 27 may be added before it is pumped into a tickle refiner 29 which makes some fine-tuned adjustments to the lignocellulosic fibers to change the freeness of the stock and improve paper formation at the papermachine 10. The refined papermaking slurry 31 is then sent to the stuff box 33, which assists with precisely metering in the required amount of the prepared papermaking base slurry to be diluted with the papermachine white water 35. Other auxiliary papermaking additives 37 may be added to the white water 35 that is used to dilute the stuff box stock 39 and/or directly to the stuff box stream 39.

This diluted papermaking slurry 41 is typically pumped into some cleaners 43 (which removes selected trace contaminants), which then goes to a deculator 45 to removed dissolved and entrained air in the slurry. Other auxiliary papermaking additives 47 may be added to the stock 49 at a point 50 downstream of the deculator 45 but prior to pump 51.

The pumped slurry 53 then goes through screens 55 to remove undesired contaminants that the pulp slurry may contain. After screening, the papermaking slurry 57, modified with additional additives 58 if so desired, is sent to the papermachine headbox 59 where slurry is made into a wet paper web, which is then pressed to remove additional water, and finally sent to a drying operation (not shown). The drying operation uses heat to drive off most of the remaining water in the pressed sheet and results in the finished sheet of paper or paperboard. The water removed during the initial wet paper web formation from the papermaking slurry, after some processing steps, is referred to as white water and it is used again to dilute the base papermaking stock, as mentioned above. It should be understood that this is one example of a papermaking operation, but that other schemes may also be practiced as are known in the art, and the present invention is equally applicable to these other known papermaking operations in terms of using the quaternized alkanolamine fatty acid ester compounds for optical property control in opacity relevant grades of paper or paperboard products.

The quaternary ammonium product(s), in neat (100% active) or formulated forms, can be added in an effective amount to a papermaking slurry in virtually any location in the overall operation, or in multiple locations if so desired. For example, the neat or formulated quaternary ammonium product(s) can be added directly to the lignocellulosic fibers and mixed prior to the blend chest. The lignocellulosic fibers can be from mechanical pulps, e.g., thermomechanical pulp (TMP), or chemical pulps, e.g., Kraft pulp, or can be from repulped recycled fibers, e.g., deinked pulp. Other examples include: (1) adding the neat or formulated quaternary ammonium product(s) directly to the inorganic filler or pigment with mixing prior to the blend chest; (2) adding the quaternized alkanolamine fatty acid ester compounds directly to the dilution water (i.e., white water) with mixing prior to the blend chest; (3) splitting the formulated quaternary ammonium product(s) into multiple feeds and adding to one or more of the above feeds prior to the blend chest; (4) adding the neat or formulated quaternary ammonium product(s) as a separate component directly going into the blend chest; (5) adding the neat or formulated quaternary ammonium product(s) to one or more process points in the wet end operations such as just prior to the suction side of process pumps or to the feed of the refiner; (6) adding the neat or formulated quaternary ammonium product(s) to the white water, which is then used to dilute the stuff box papermaking slurry; and (7) splitting the neat or formulated quaternary ammonium product(s) into multiple feed streams and adding them to one or more of the above mention areas in the wet end operations.

In a broad sense, the quaternized alkanolamine fatty acid ester compounds can be added as a wet-end additive directly to the papermaking operation at any or more than one location in the operation. Alternatively, the quaternized alkanolamine fatty acid ester compounds can be added to one or more components used to produce the slurry such as the pulp, either virgin or recycled, white water, and additives/chemicals as would be normally used in papermaking. Further, more than one of the quaternized alkanolamine fatty acid ester compounds can be used in combination for control of optical properties if so desired. Since the quaternized alkanolamine fatty acid ester compounds are shown herein to be capable of replacing other known inorganic fillers or pigments such as kaolin clay, calcined clay, GCC, PCC or titanium dioxide, the compounds can be added to the papermaking operation in combination with these typical filler/pigments, and especially as a means to reduce the loading of these filler/pigments without compromising optical properties such as opacity.

In addition to the preferred liquid form, the quaternary compounds of this invention can be supplied as a solid (or paste-like) high actives product that can be melted on-site at the mill, and the resulting melted solid can be mixed with the papermaking slurry, or to one or more of the individual components comprising the slurry, for the express purpose of enhancing the opacity of the resulting paper or paperboard product. The degree of liquidity or solidity of the quaternary compounds themselves is dependent on a number of factors such as the degree of quaternization imparted to the alkanolamine fatty acid ester intermediate as well as the compositional nature of the starting fatty acid employed in making the ester intermediate. Important compositional factors with respect to the fatty acid reactants include the carbon chain length and/or chain length distributions present, the degree of saturation versus unsaturation present, and branching versus linearity.

The addition of the disclosed quaternized alkanolamine fatty acid ester compounds, as wet-end opacification aids, to the papermaking slurry is not limited to the above generic description as these quaternary compounds can, for example, be added directly to the virgin and/or recycle paper fiber, and/or to the filler/pigment slurries. It is also envisioned that in highly closed systems and systems with high levels of dissolved and colloidal substances, in particular species that contribute to anionic trash, that the introduction of various cationic coagulants and/or flocculants both of organic and inorganic origins could be of benefit and improve the performance of the invention.

While the addition of the quaternized alkanolamine fatty acid ester compounds is broadly described in terms of an effective amount to the papermaking operation, more preferred amounts can range up to about 100 lbs. of the compound on an active basis per bone dry ton of the pulp slurry solids. Other preferred amounts include up to about 5, 10, 15, 20, and 25 lbs. of quaternary compound on an active basis per ton of the bone dry slurry solids.

Comparative Testing

In an effort to demonstrate the unexpected improvements in opacity when using the quaternized alkanolamine fatty acid ester compounds in papermaking, a number of prior art compounds and quaternary ammonium compounds according to the invention were synthesized. The details regarding the making of these compounds are listed below under the heading "SYNTHESIS OF COMPOUNDS." These various compounds in terms of their principal characteristic are listed in the following Table 0 and were employed in various studies as detailed below under the heading of "TESTS". Examples including "PA" represent prior art aids, and examples employing "INV" are quaternized alkanolamine fatty acid ester compounds for use within the teachings of the present invention.

TABLE 0

| Compound | Characteristic |
|---|---|
| Example 1-PA | mono- & disteramide of aminoethylethanol (prior art) |
| Example 2-PA | difatty ester amine from tall oil fatty acid and triethanolamine (TEA) (prior art) |
| Example 3-INV | difatty ester amine quaternary synthesized from tall oil/TEA, and methyl sulfate salt (present invention) |
| Example 4-INV | difatty ester amine quaternary synthesized from tall oil/TEA, and ethyl sulfate salt (present invention) |
| Example 5-INV | commercially available difatty ester amine quaternary (tallow oil fatty acid) |
| Example 6-INV | commercially available difatty ester amine quaternary (present invention) |
| Example 7-PA | difatty ester amine synthesized from stearic acid/TEA (prior art) |
| Example 8-INV | difatty ester amine quaternary synthesized from stearic acid/TEA, and ethyl sulfate salt (present invention) |

TABLE 0-continued

| Compound | Characteristic |
|---|---|
| Example 9-INV | difatty ester amine quaternary synthesized from stearic acid/TEA, and methyl sulfate salt (present invention) |
| Example 10-PA | difatty ester amine synthesized from stearic acid/MDEA, (prior art) |
| Example 11-INV | difatty ester amine quaternary synthesized from stearic acid/MDEA, and methyl sulfate salt (present invention) |
| Example 12-PA | commercially available dialkyl amidoamine quaternary (prior art) |
| Example 13-INV-PG | difatty ester amine quaternary synthesized from tall oil/TEA, and methyl sulfate salt, diluted with propylene glycol (present invention) |
| Example 14-INV-IA | difatty ester amine quaternary synthesized from tall oil/TEA, and methyl sulfate salt, diluted with isopropyl alcohol (present invention) |
| Example 15-INV | difatty ester amine quaternary synthesized from lauric acid/TEA, and methyl sulfate salt (present invention) |
| Example 16-INV | difatty ester amine quaternary synthesized from myristic acid/TEA, and methyl sulfate salt (present invention) |
| Example 17-INV | difatty ester amine quaternary synthesized from palmitic acid/TEA, and methyl sulfate salt (present invention) |
| Example 18-INV | difatty ester amine quaternary synthesized from behenic acid/TEA, and methyl sulfate salt (present invention) |
| Example 19-INV | difatty ester amine quaternary synthesized from oleic acid/TEA, and methyl sulfate salt (present invention) |
| Example 20-INV | difatty ester amine quaternary synthesized from linoleic acid/TEA, and methyl sulfate salt (present invention) |
| Example 21-INV | difatty ester amine quaternary synthesized from linolenic acid/TEA, and methyl sulfate salt (present invention) |
| Example 22-INV | difatty ester amine quaternary synthesized from eruric acid/TEA, and methyl sulfate salt (present invention) |
| Example 23-INV | difatty ester amine quaternary synthesized from isostearic acid/TEA, and methyl sulfate salt (present invention) |

Synthesis of Compounds

Example 1-PA

Synthesis of Mono- & Disteramides of AEEA

Samples of the mono- and disteramides of aminoethylethanol amine (AEEA) were prepared by reacting stearic acid with AEEA, and forming the 11% solids aqueous emulsion as disclosed in U.S. Pat. No. 5,296,024.

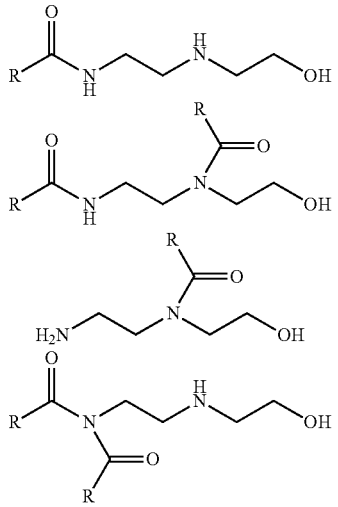

Mono- & disteramides of Aminoethylethanol Amine (AEEA):

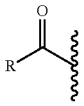

= from Stearic Acid

Example 2-PA

Synthesis 2TOFA/TEA

To a round bottom flask was added 164.4 grams of a tall oil fatty acid (TOFA)(acid number 172 mg of KOH/g; Iodine value ~70 gI/100 g), 45.4 g of triethanolamine (TEA), and 0.2 g of hydrated monobutyltin oxide. The contents were heated to ~155° C. with a nitrogen sparge, mixed and allowed to react at temperature until the acid value of the reaction product dropped below 4.8. The finished product was a dark amber liquid at room temperature.

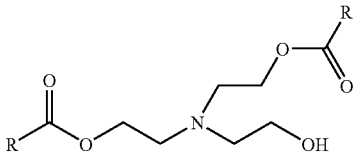

Difatty Ester Amine

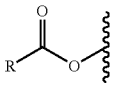

= from Tall oil fatty acid (TOFA)

Example 3-INV

Synthesis of Me Quat 2TOFA/TEA (Methyl Sulfate Salt)

To a round bottom flask was added 200 grams 2tall oil fatty acid (2TOFA)/TEA. The contents were heated to ~70° C. and sparged with nitrogen gas. To the heated material was added 32 grams of dimethyl sulfate (DMS) with stirring. The DMS was slowly dripped into the 2TOFA/TEA over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were mid- to dark amber color and appeared very viscous but not to the point of being a paste.

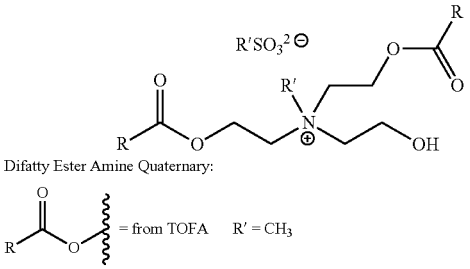

Example 4-INV

Synthesis of Et Quat 2TOFA/TEA (Ethyl Sulfate Salt)

To a round bottom flask was added 200 grams 2TOFA/TEA. The contents were heated to ~70° C. and sparged with nitrogen gas. To the heated material was added 40 grams of diethyl sulfate (DES) with stirring. The DES was slowly dripped into the 2TOFA/TEA over 1 hour period. The temperature of the reaction was allowed to climb to 85 to 90° C. during the DES addition. After all the DES was added, the reaction was allowed to mix at 85 to 90° C. for an additional 2 hours. After this post 2-hour reaction time, the finished sample was allowed to cool. The formed compounds were mid- to dark amber color and appeared very viscous but not to the point of being like a paste.

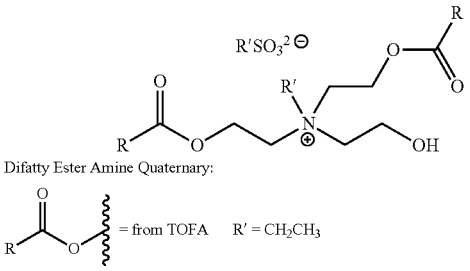

Example 5-INV

A commercially available sample known as Stepantex VK 90 was obtained from Stepan Company, Northfield, Ill. USA. The sample is a quaternized tallow fatty acid ester amine.

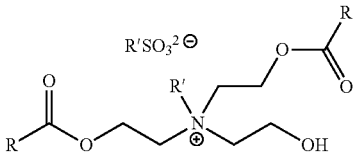

-continued

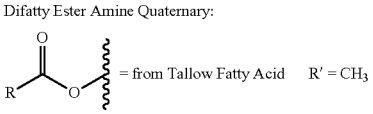

Example 6-INV

A commercially available sample known as Varisoft WE 16 was obtained from Goldschmidt Chemical Corp., Hopewell, Va. The sample has a CAS No. 157905-74-3 and is Ethanaminium, 2-Hydroxy-N,N-bis(2-hydroxyethyl)-N-methyl-, esters with $C_{16-18}$ and $C_{18}$-unsatd. fatty acids, Me Sulfate (salts).

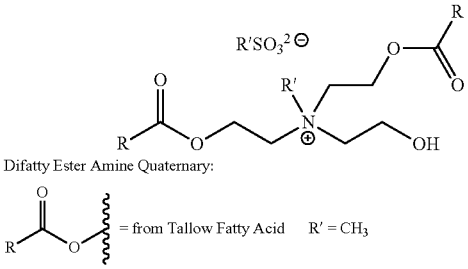

Example 7-PA

Synthesis Stearic Acid/TEA

To a round bottom flask was added 408.5 grams of 90% stearic acid (acid number 200 mg of KOH/g), 91.0 g of triethanolamine (TEA), and 0.5 g of hydrated monobutyltin oxide which is referred to here forward as "2Stearic Acid/TEA". The contents were heated to ~155° C. with a nitrogen sparge, mixed and allowed to react at temperature until the acid value of the reaction product dropped below 4.8. The finished product was a caramel colored solid wax at room temperature.

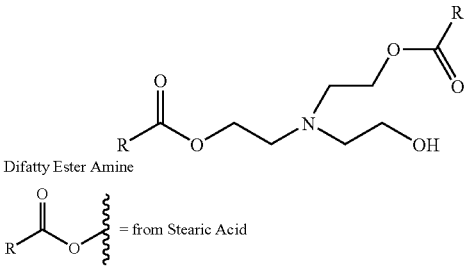

Example 8-INV

Synthesis of Et Quat of Stearic Acid/TEA (Ethyl Sulfate Salt)

To a round bottom flask was added 173.4 grams of 2Stearic Acid/TEA. The contents were melted to ~80° C. and sparged with nitrogen gas. To the heated material was added 26.6 grams of DES with stirring. The DES was slowly dripped into the 2Stearic Acid/TEA over 1 hour period. The temperature of the reaction was allowed to climb to 85 to 90° C. during the DES addition. After all the DES was added, the reaction was allowed to mix at 85 to 90° C. for an additional 2 hours. After this post 2 hour reaction time, the finished sample was allowed to cool. The formed compounds were a light brown wax.

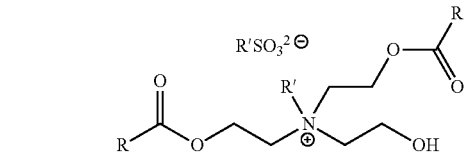

Difatty Ester Amine Quaternary:

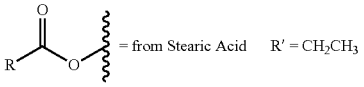

= from Stearic Acid R′ = $CH_2CH_3$

Example 9-INV

Synthesis of Me Quat of Stearic Acid/TEA (Methyl Sulfate Salt)

To a round bottom flask was added 200 grams of 2Stearic Acid/TEA. The contents were melted to ~80° C. and sparged with nitrogen gas. To the heated material was added 25.1 grams of DMS with stirring. The DMS was slowly dripped into the 2Stearic Acid/TEA over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were a light brown cream wax.

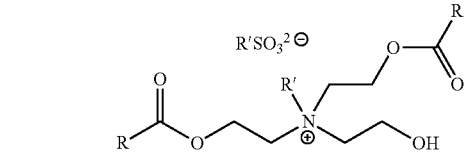

Difatty Ester Amine Quaternary:

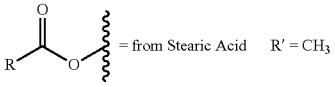

= from Stearic Acid R′ = $CH_3$

Example 10-PA

Synthesis Stearic Acid/MDEA

To a round bottom flask was added 410 grams of 90% stearic acid (acid number 200 mg of KOH/g), 89.5 g of methyldiethanol amine (MDEA), and 0.5 g of hydrated monobutyltin oxide known from here forward as "2Stearic Acid/MDEA". The contents were heated to ~155° C. with a nitrogen sparge, mixed and allowed to react at temperature for 4 hours. The finished product was a brown solid wax at room temperature.

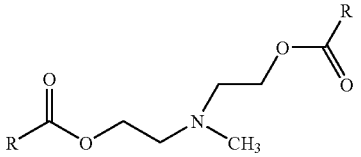

Difatty Ester Amine

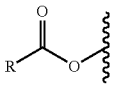

= from Stearic Acid

Synthesis of Et Quat Stearic Acid/MDEA

To a round bottom flask was added 167.4 grams of 2Stearic Acid/MDEA. The contents were melted to ~85° C. and sparged with nitrogen gas. To the heated material was added 32.6 grams of DES with stirring. The DES was slowly dripped into the 2Stearic Acid/MDEA over 1 hour period. The temperature of the reaction was allowed to climb to 85 to 90° C. during the DES addition. After all the DES was added, the reaction was allowed to mix at 85 to 115° C. for an additional 2 hours. After this post 2-hour reaction time, the finished sample was allowed to cool. The formed compound is a brown wax.

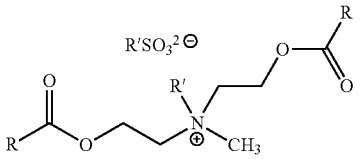

Difatty Ester Amine Quaternary:

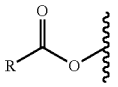

= from Stearic Acid R′ = $CH_2CH_3$

Example 12-PA

Synthesis of N-methyl, N,N-bis(hydrogenated tallow amino ethyl)-N-polyethoxy ammonium methosulfate:)

A commercially available sample of N,N-bis(hydrogenated tallow amino ethyl)-N-polyethoxy ammonium methosulfate was obtained from Croda Inc. (Parsippany, N.J. USA).

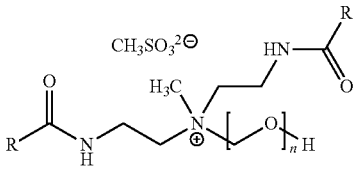

Dialkyl Amidoamine Quaternary:

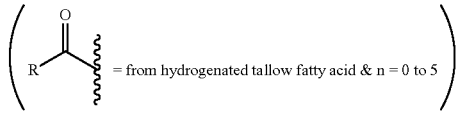

= from hydrogenated tallow fatty acid & n = 0 to 5

Example 13-INV-PG

Synthesis and Formulation of Me Quat 2TOFA/TEA (Methyl Sulfate Salt)

To a round bottom flask was added 200 grams 2tall oil fatty acid (2TOFA)/TEA. The contents were heated to ~70° C. and sparged with nitrogen gas. To the heated material was added 32 grams of DMS with stirring. The DMS was slowly dripped into the 2TOFA/TEA over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were mid- to dark amber color and appeared very viscous but not to the point of being like a paste. To this material 10 wt % propylene glycol was mixed into the sample. The resulting samples were homogeneous clear liquids.

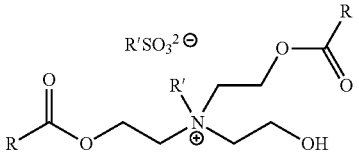

Difatty Ester Amine Quaternary:

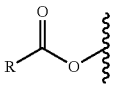

= from TOFA R' = $CH_3$

Example 14-INV-IA

Synthesis and Formulation of Me Quat 2TOFA/TEA (Methyl Sulfate Salt)

To a round bottom flask was added 200 grams 2tall oil fatty acid (2TOFA)/TEA. The contents were heated to ~70° C. and sparged with nitrogen gas. To the heated material was added 32 grams of DMS with stirring. The DMS was slowly dripped into the 2TOFA/TEA over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were mid- to dark amber color and appeared very viscous but not to the point of being like a paste. To this material 10 wt % isopropyl alcohol was mixed into the sample. The resulting samples were homogeneous clear liquids.

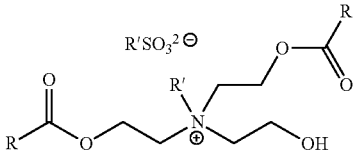

Difatty Ester Amine Quaternary:

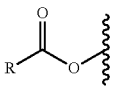

= from TOFA R' = $CH_3$

Example 15-INV

Synthesis Me Quat. Lauric Acid/TEA(Methyl Sulfate Salt

To a round bottom flask was added 364.0 grams of ~99% lauric acid (acid number 280 mg of KOH/g), 135.5 g of triethanol amine (TEA), and 0.5 g of hydrated monobutyltin oxide. The contents were heated to ~155° C. with a nitrogen sparge, mixed and allowed to react at temperature for 2.5 hours. The finished difatty ester amine intermediate product was a clear dark amber liquid at room temperature with an acid number of 4.8 mg of KOH/g.

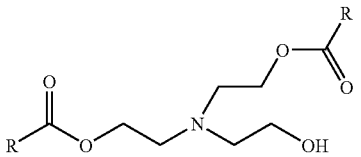

Difatty Ester Amine Intermediate

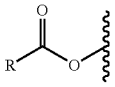

= from Lauric Acid

To a round bottom flask was added 200 grams of the above intermediate. The contents were heated to ~80° C. and sparged with nitrogen gas. To the heated material was added 39.4 grams of DMS with stirring. The DMS was slowly dripped into the intermediate over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were a brown wax-like solid.

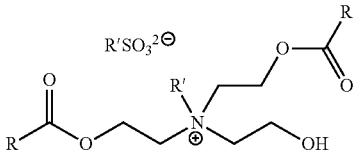

Difatty Ester Amine Quaternary:

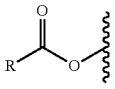

= from Lauric Acid R' = $CH_3$

Example 16-INV

Synthesis Me Quat. Myristic Acid/TEA(Methyl Sulfate Salt)

To a round bottom flask was added 271.08 grams of ~96.5% myristic acid (acid number 245 mg of KOH/g), 88.56 g of triethanolamine (TEA), and 0.36 g of hydrated monobutyltin oxide. The contents were heated to ~155° C. with a nitrogen sparge, mixed and allowed to react at temperature for 3.5 hours. The finished difatty ester amine intermediate product was a clear dark amber liquid at room temperature with an acid number of 4.3 mg of KOH/g.

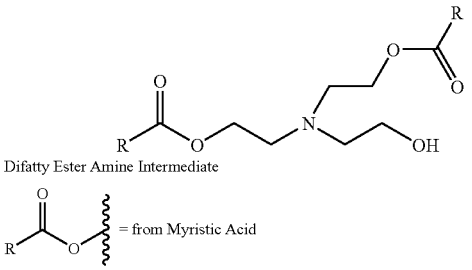

To a round bottom flask was added 200 grams of the above intermediate. The contents were heated to ~80° C. and sparged with nitrogen gas. To the heated material was added 35.8 grams of DMS with stirring. The DMS was slowly dripped into the intermediate over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were a brown wax-like solid.

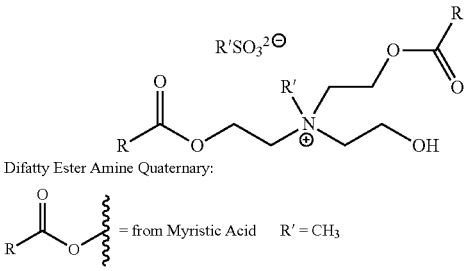

Example 17-INV

Synthesis Me Quat. Palmitic Acid/TEA(Methyl Sulfate Salt)

To a round bottom flask was added 387.0 grams of ~93% palmitic acid (acid number 218 mg of KOH/g), 112.5 g of triethanolamine (TEA), and 0.5 g of hydrated monobutyltin oxide. The contents were heated to ~155° C. with a nitrogen sparge, mixed and allowed to react at temperature for 3 hours. The finished difatty ester amine intermediate product was a brown solid wax at room temperature with an acid number of 3.6 mg of KOH/g.

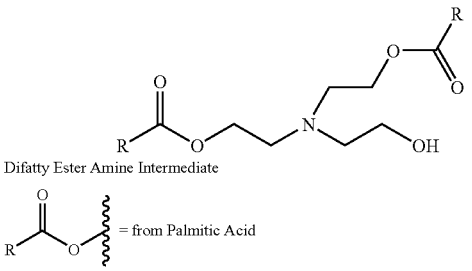

To a round bottom flask was added 200 grams of the above intermediate. The contents were heated to ~80° C. and sparged with nitrogen gas. To the heated material was added 32.7 grams of DMS with stirring. The DMS was slowly dripped into the intermediate over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were a brown wax-like solid.

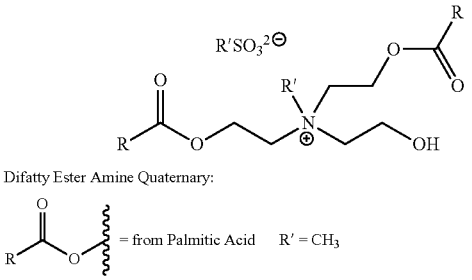

Example 18-INV

Synthesis Me Quat. Behenic Acid/TEA(Methyl Sulfate Salt)

To a round bottom flask was added 409.5 grams of ~89% behenic acid (acid number 167 mg of KOH/g), 90 g of triethanolamine (TEA), and 0.5 g of hydrated monobutyltin oxide. The contents were heated to ~155° C. with a nitrogen sparge, mixed and allowed to react at temperature for 2 hours. The finished difatty ester amine intermediate product was a light cream solid wax at room temperature with an acid number of 4.0 mg of KOH/g.

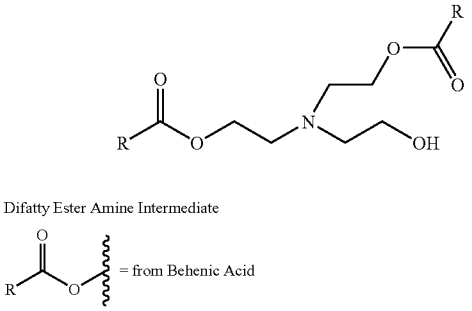

To a round bottom flask was added 200 grams of the above intermediate. The contents were heated to ~80° C. and sparged with nitrogen gas. To the heated material was added 26.2 grams of DMS with stirring. The DMS was slowly dripped into the intermediate over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were a light cream wax-like solid.

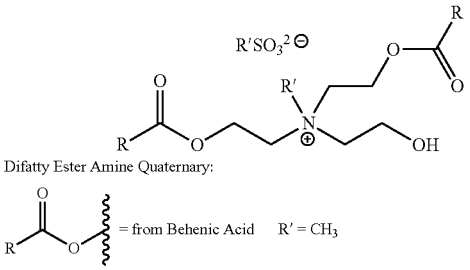

Example 19-INV

Synthesis Me Quat. Oleic Acid/TEA(Methyl Sulfate Salt)

To a round bottom flask was added 395.0 grams of ~80% Oleic acid vegetable-based high C18:1 (acid number 193 to 203 mg of KOH/g; Iodine value 90 to 97 gI/100 g), 104.5 g of triethanolamine (TEA), and 0.5 g of hydrated monobutyltin oxide. The contents were heated to ~155° C. with a nitrogen sparge, mixed and allowed to react at temperature for 2 hours. The finished difatty ester amine intermediate product was an amber liquid at room temperature with an acid number of 4.3 mg of KOH/g.

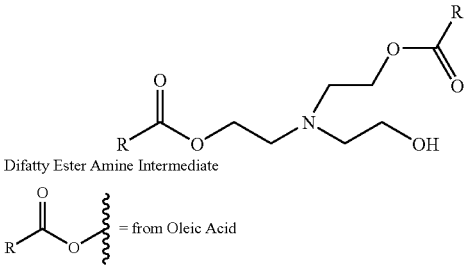

To a round bottom flask was added 200 grams of the above intermediate. The contents were heated to ~80° C. and sparged with nitrogen gas. To the heated material was added 30.5 grams of DMS with stirring. The DMS was slowly dripped into the intermediate over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were mid- to dark amber color and appeared very viscous but not to the point of being like a paste.

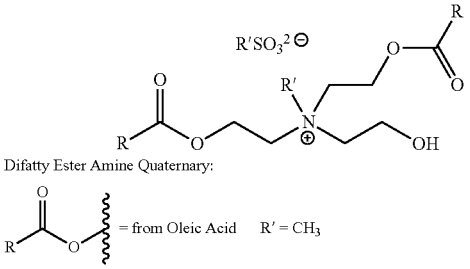

Example 20-INV

Synthesis Me Quat. Linoleic Acid/TEA(Methyl Sulfate Salt)

To a round bottom flask was added 456.0 grams of ~90% linoleic acid (acid number ~200 mg of KOH/g; Iodine value ~181 gI/100 g), 123 g of triethanolamine (TEA), and 0.58 g of hydrated monobutyltin oxide. The contents were heated to ~155° C. with a nitrogen sparge, mixed and allowed to react at temperature for 6 hours. The finished difatty ester amine intermediate product was amber liquid at room temperature with an acid number of 1.5 mg of KOH/g.

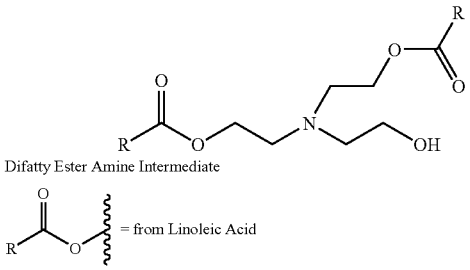

To a round bottom flask was added 200 grams of the above intermediate. The contents were heated to ~80° C. and sparged with nitrogen gas. To the heated material was added 32 grams of DMS with stirring. The DMS was slowly dripped into the intermediate over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were mid- to dark amber color and appeared very viscous but not to the point of being like a paste.

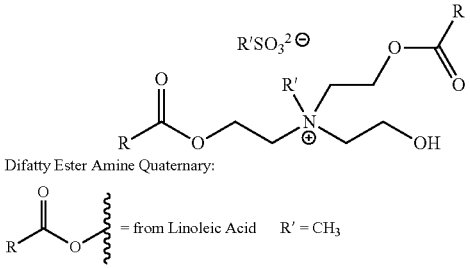

Example 21-INV

Synthesis Me Quat. Linolenic Acid/TEA(Methyl Sulfate Salt)

To a round bottom flask was added 228.0 grams of ~70% linolenic acid (acid number ~200 mg of KOH/g; Iodine value ~274 gI/100 g), 52.25 g of triethanolamine (TEA), and 0.25 g of hydrated monobutyltin oxide. The contents were heated to ~155° C. with a nitrogen sparge, mixed and allowed to react at temperature for 2 hours. The finished difatty ester amine intermediate product was an amber liquid at room temperature with an acid number of 4 mg of KOH/g.

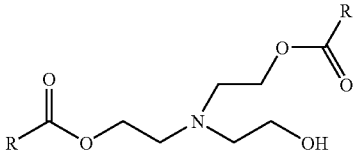

Difatty Ester Amine Intermediate

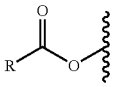

= from Linolenic Acid

To a round bottom flask was added 200 grams of the above intermediate. The contents were heated to ~80° C. and sparged with nitrogen gas. To the heated material was added 30.5 grams of DMS with stirring. The DMS was slowly dripped into the intermediate over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds is mid- to dark amber color and appeared very viscous but not to the point of being like a paste.

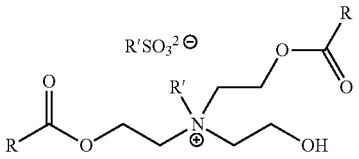

Difatty Ester Amine Quaternary:

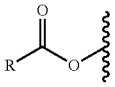

= from Linolenic Acid $R' = CH_3$

Example 22-INV

Synthesis Me Quat. Erucic Acid/TEA(Methyl Sulfate Salt)

To a round bottom flask was added 409.5 grams of ~91% Erucic acid (acid number 76 mg of KOH/g; Iodine value ~165 gI/100 g), 90 g of triethanolamine (TEA), and 0.5 g of hydrated monobutyltin oxide. The contents were heated to ~155° C. with a nitrogen sparge, mixed and allowed to react at temperature for 2 hours. The finished difatty ester amine intermediate product was a light cream solid wax at room temperature with an acid number of 4.2 mg of KOH/g.

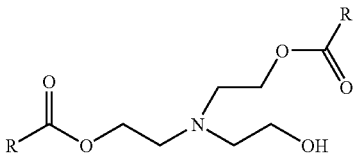

Difatty Ester Amine Intermediate

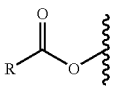

= from Erucic Acid

To a round bottom flask was added 200 grams of the above intermediate. The contents were heated to ~80° C. and sparged with nitrogen gas. To the heated material was added 26.2 grams of DMS with stirring. The DMS was slowly dripped into the intermediate over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds were a light cream wax-like solid.

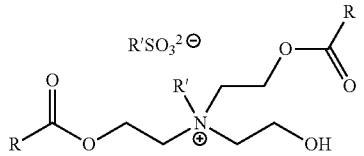

Difatty Ester Amine Quaternary:

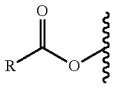

= from Erucic Acid $R' = CH_3$

Example 23-INV

Synthesis Me Quat. Isostearic Acid/TEA(Methyl Sulfate Salt)

To a round bottom flask was added 391.0 grams of Isostearic acid (acid number 180-195 mg of KOH/g), 108.4 g of triethanolamine (TEA), and 0.5 g of hydrated monobutyltin oxide. The contents were heated to ~155° C. with a nitrogen sparge, mixed and allowed to react at temperature for 1.5 hours. The finished difatty ester amine intermediate product was a clear yellow liquid at room temperature with an acid number of 4.9 mg of KOH/g.

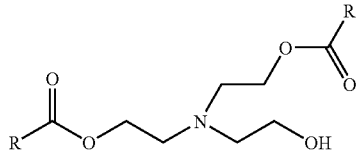

Difatty Ester Amine Intermediate

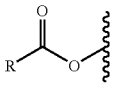

= from Isostearic Acid

To a round bottom flask was added 200 grams of the above intermediate. The contents were heated to ~80° C. and sparged with nitrogen gas. To the heated material was added 32.0 grams of DMS with stirring. The DMS was slowly dripped into the intermediate over 1 hour period. The temperature of the reaction was allowed to climb to 85 to 90° C. during the DMS addition. After all the DMS was added, the reaction was allowed to mix at 85 to 90° C. for an additional 1 hour. After this post 1 hour reaction time, the finished sample was allowed to cool. The formed compounds is mid- to dark amber color and appeared very viscous but not to the point of being like a paste.

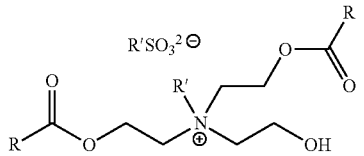

Difatty Ester Amine Quaternary:

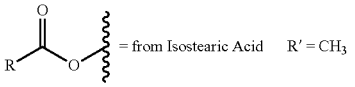

Studies

A series of paper application studies were performed to compare the synthesized compounds described above amongst each other to demonstrate the unexpected benefits achieved when using the quaternized alkanolamine fatty acid ester compounds of this invention in papermaking operations. The application tests were performed in various pulp slurries at several addition levels of compound. Papermaking slurries were obtained from papermills or made from re-pulped paper. The resulting stock was diluted to about 1% consistency (1% wt./wt. solids in water). Paper handsheets were made using standard laboratory papermaking equipment (i.e., TAPPI Sheet Machine; Described in Appendix A, Section A2 of TAPPI Standard T205-om88 "Forming handsheets for physical test of pulps" (TAPPI Test Methods, TAPPI Press, Atlanta, Ga.)). In this process a fixed amount of the about 1% stock solution was weighed out (~120 to 160 g) so that the formed sheet on the laboratory sheet former yielded a sheet grammage close to 60 grams/sq. meter. (g/sq. m), or different grammage sheet (as noted). To the about 1% pulp slurry was added the appropriate amount of opacification aid and mixed at 600 rpm for 60 seconds. Afterwards, this mixture was introduced into the laboratory sheet former in accordance to Sections 7.2 through 7.5 of TAPPI Standard T205-om88. The resulting wet-pressed sheets were then dried on an Adirondack drum dryer set at 125° C., at a speed of 60 to 70% and a dryer fabric tension of 0.45 MPa (65 psig).

The resulting paper handsheets were tested for opacity using a Technobrite TB-1C instrument (Technidyne Corp., New Albany, Ind. USA) in accordance to Section 10 of TAPPI Standard T519 om91 ("Diffuse opacity of paper") and the reported % TAPPI Opacity values are the values the Technobrite TB-1C instrument calculates during this measurement. Differences in opacity between the control and test sheets is referred to in the tests below as delta opacity. Scattering coefficients were determined using Kubelka-Munk calculations. Brightness measurements were also performed on the Technobrite TB-1C instrument in accordance to TAPPI Standard T525 om92 ("Diffuse Brightness of pulp") and the values reported are % ISO Brightness are the values the Technobrite TB-1C instrument calculates during this measurement. Physical strength testing on selected paper handsheets were conducted in accordance to TAPPI Standard T220 sp96 ("Physical testing of pulp handsheets").

Tappi Test Method T411 was used to evaluate caliper of the test sheets for assessing the influence on bulking by the various wet-end additives. This method, "Thickness (caliper) of paper, paperboard and bomined board", states the measurement of paper caliper, used to determine bulk (=caliper/sheet grammage) has a reproducibility of 5.5%.

Test 1

This test utilized a newsprint stock obtained from the Southeastern US. The stock was composed of 70% hydrosulfite bleached thermomechanical pulp (TMP) and 30% deinked recycled newsprint pulp. The stock had a pH of 6.5-6.7 and the resulting test sheet grammage was 60.3 g/square meter. The dosage of the additive as per Table I is given in active pounds of additive per bone dry ton of slurry solids (lb/t).

TABLE I

| Opacification Treatment | TAPPI Opacity (%) | Delta Opacity (% Points) | Brightness (% ISO) |
|---|---|---|---|
| No additives (control) | 92.5 | — | 56.2 |
| 20 lb/t Example 1-PA | 93.7 | 1.2 | 57.2 |
| 20 lb/t Example 2-PA | 93.8 | 1.2 | 56.5 |
| 20 lb/t Example 3-INV | 96.1 | 3.6 | 58.1 |
| 20 lb/t Example 4-INV | 95.9 | 3.3 | 58.2 |
| 20 lb/t Example 5-INV | 96.5 | 4.0 | 56.5 |
| 20 lb/t Example 6-INV | 96.0 | 3.5 | 57.6 |
| 20 lb/t Example 7-PA | 92.9 | 0.4 | 55.4 |
| 20 lb/t Example 8-INV | 94.3 | 1.8 | 56.4 |
| 20 lb/t Example 9-INV | 95.6 | 3.0 | 56.6 |
| 20 lb/t Example 10-PA | 93.4 | 0.9 | 55.5 |
| 20 lb/t Example 11-INV | 95.8 | 3.2 | 55.9 |

The results shown in Table I compare opacity and brightness values for a control sheet where no additive is used, a prior art organic opacification aid consisting of a fattyamide of alkanoldiamine (Example 1-PA), prior art opacification aids consisting of alkanolamine difatty acid esters (Example 2-PA, 7-PA & 10-PA), and various quaternized salts of the alkanolamine fatty acid esters as per the teachings of this invention (Examples 3-INV, 4-INV, 5-INV, 6-INV, 8-INV, 9-INV, and 11-INV).

Addition of the quaternized alkanolamine fatty acid esters increased the paper opacity >3% points over the control and were clearly much higher than the fattyamides of alkanoldiamines (Example 1-PA) and the alkanolamine difatty acid esters (Example 2-PA, 7-PA & 10-PA). Furthermore, the sheet brightness provided by the quaternized alkanolamine fatty acid esters (Examples 3-, 4-, 5-, 6-, 8-, 9- and 11-INV) was either comparable or superior to that observed for the other comparative test sheets.

Test 2

Test 2 utilized a newsprint stock obtained from the Southeastern US, employed the compound from example 3-INV, and investigated the effect on opacity as it relates to the amount of quaternary ammonium compound used. The stock was composed of 70% hydrosulfite bleached thermomechanical pulp (TMP) and 30% deinked recycled newsprint pulp. The stock had a pH of 6.5-6.7 and the resulting test sheet grammage was 60.3 g/square meter. The dosage of the additive as per Table II is given in active pounds of additive per bone dry ton of slurry solids (lb/t).

TABLE II

| Opacification Treatment | TAPPI Opacity (%) | Delta Opacity (% Points) | Brightness (% ISO) |
|---|---|---|---|
| No additives (control) | 93.0 | — | 56.3 |
| 5 lb/t Example 3-INV | 93.9 | 0.9 | 56.7 |
| 10 lb/t Example 3-INV | 95.7 | 2.7 | 57.7 |
| 15 lb/t Example 3-INV | 95.9 | 2.9 | 57.9 |
| 20 lb/t Example 3-INV | 96.6 | 3.6 | 57.9 |

Table II shows that as the dosage (lb/t) of the 3-INV additive is increased that the resultant sheet opacity increases while no deleterious impacts are observed on sheet brightness. The observed delta opacity increase ranged from 0.9% units at 5 lb/t addition level to 3.6% units at 20 lb/t.

Test 3

This example utilized a newsprint machine stock obtained from the Southeastern US, and compared three prior art opacification aids, Example 1-PA which is a fatty amide of an alkanoldiamine, and 2-PA which is a alkanolamine difatty acid ester, with three different quaternized alkanolamine fatty acid ester compounds, namely Examples 3-INV, 5-INV, and 6-INV. The stock was composed of 70% hydrosulfite bleached thermomechanical pulp (TMP) and 30% deinked recycled newsprint pulp. The stock had a pH of about 6.6 and the resulting test sheet grammage was 61.9 g/square meter. The dosage of the additive as per Table III is given in active pounds of additive per bone dry ton of slurry solids (lb/t).

TABLE III

| Lb/t | Example 1-PA | Example 2-PA | Example 3-INV | Example 5-INV | Example 6-INV |
|---|---|---|---|---|---|
| TAPPI Opacity Values (%) | | | | | |
| 0 | 93.2 | 93.2 | 93.2 | 93.2 | 93.2 |
| 10 | 94.3 | 93.3 | 94.8 | 94.1 | 94.2 |
| 15 | 94.2 | 94.4 | 95.0 | 94.7 | 94.7 |
| 20 | 94.8 | 94.3 | 95.5 | 95.6 | 95.6 |
| 25 | 95.4 | 94.5 | 96.4 | 96.3 | 96.3 |
| Delta TAPPI Opacity Gain (% Points) | | | | | |
| 10 | 1.1 | 0.1 | 1.6 | 0.9 | 1.0 |
| 15 | 1.0 | 1.2 | 1.8 | 1.5 | 1.5 |
| 20 | 1.6 | 1.1 | 2.3 | 2.4 | 2.4 |
| 25 | 2.2 | 1.3 | 3.2 | 3.1 | 3.1 |

Table III shows that the addition of the quaternized alkanolamine fatty acid esters all increased the paper opacity>3% units over the control sheet and were clearly higher than the two prior art opacification compounds (e.g., a fattyamide of an alkanoldiamine and an/alkanolamine difatty acid ester). For example, at a 25 lb/t addition level, each of Examples 3, 4, and 5-INV greatly outperformed the prior art opacification aids.

Test 4

This test utilized a newsprint machine stock obtained from the Southeastern US and investigated the effect of the active basis concentration of the quaternized alkanolamine fatty acid ester compound utilized in the applied opacification aid. The stock was composed of 70% hydrosulfite bleached thermomechanical pulp (TMP) and 30% deinked recycled newsprint pulp. The stock had a pH of about 6.6 and the resulting test sheet grammage was 61.9 g/square meter. The dosage of the opacification additive as per Table IV is given in "as is" pounds of additive per bone dry ton of slurry solids (lb/t of additive containing the quaternized alkanolamine fatty acid ester 3-INV at a specified concentration).

TABLE IV

| Opacification Treatment | TAPPI Opacity (%) | Delta Opacity (% Points) |
|---|---|---|
| Control | 93.3 | — |
| 10 lb/t Example 3-INV | 94.9 | 1.6 |
| 10 lb/t Example 13-INV-PG | 94.8 | 1.5 |
| 10 lb/t Example 14-INV-IA | 95.0 | 1.7 |

The results shown in Table IV compare the opacity of the control sheet (no opacification aid added), with a test sheet containing Example 3-INV wherein the quaternary ammonium compound is being used as a viscous liquid in a 100% active form, a test sheet containing Example 13-INV-PG which is the quat of Example 3-INV blended with 10% propylene glycol to yield a formulated liquid product, and a test containing Example 14-INV-IA which is the quat of Example 13-INV blended with 10% isopropanol to yield a formulated liquid product. All three additives were added to the papermaking slurry on an "as is" basis at 10 lb/t and all three provided similar opacification gains versus the control sheet. Thus the quaternized alkanolamine fatty acid ester compounds of this invention can be effectively utilized both as a 100% active product or as a formulated liquid product containing the quat plus a diluent at levels of about 10% with no observable impact on the resulting opacification performance.

Test 5

This application study investigated the opacification effect of a quaternized alkanolamine fatty acid ester compound, 3-INV, on stock employing Kraft pulp. More particularly, the stock was derived from a blend of 50% bleached Kraft pulp from southern pine and 50% bleached Kraft from hardwood. The stock had a pH of about 7 and the resulting test sheet grammage was 60.5 g/square meter. The dosage of the quat additive is given as per Table V in active pounds of additive per bone dry ton of slurry solids (lb/t of quaternized alkanolamine fatty acid ester).

TABLE V

| Opacification Treatment | TAPPI Opacity (%) | Delta Opacity (% Points) |
|---|---|---|
| Control | 77.4 | — |
| 20 lb/t Example 3-INV | 81.2 | 3.8 |

The results shown in Table V demonstrate the improvement in opacity when the quaternized alkanolamine fatty acid ester is applied to the Kraft stock.

Test 6

This application study compared various quaternized alkanolamine fatty acid ester compounds derived from different types of fatty acids and a prior art difatty ester amine (Ex. 7-PA) to demonstrate the effect of saturation on resultant sheet opacity. The study utilized a newsprint stock obtained from the Southeastern US. The stock was composed of 70% hydrosulfite bleached thermomechanical pulp (TMP) and 30% deinked recycled newsprint pulp. The stock had a pH of about 6.5-6.7 and the resulting test sheet grammage was 61.5 g/square meter. The dosage of the opacification additive as per Table VI is given in active pounds of additive per bone dry ton of slurry solids (lb/t of quaternized alkanolamine fatty acid ester).

TABLE VI

| Opacification Treatment* | TAPPI Opacity (%) | Delta Opacity (% Points) | Scattering Coefficent ($m^2$/kg) | Bulk ($cm^3$/g) |
|---|---|---|---|---|
| No additive (control) | 91.8 | — | 53.1 | 2.86 |
| 15 lb/t Ex. 3-INV (uses tall oil fatty acid) | 93.3 | 1.6 | 58.6 | 2.89 |
| 15 lb/t Ex. 15-INV (uses lauric acid) | 93.3 | 1.6 | 59.1 | 2.85 |
| 15 lb/t Ex. 16-INV (uses myristic acid) | 93.1 | 1.3 | 58.4 | 2.80 |
| 15 lb/t Ex. 17-INV (uses palmitic acid) | 93.4 | 1.7 | 58.4 | 2.88 |

TABLE VI-continued

| Opacification Treatment* | TAPPI Opacity (%) | Delta Opacity (% Points) | Scattering Coefficent ($m^2$/kg) | Bulk ($cm^3$/g) |
|---|---|---|---|---|
| 15 lb/t Ex. 7-PA | 92.8 | 1.0 | 56.4 | 2.86 |
| 15 lb/t Ex. 18-INV (uses behenic acid) | 92.6 | 0.9 | 56.2 | 2.97 |

Table VI shows the various starting fatty acids used to make the different diester quat compounds that were examined as opacification aids, and this Table again shows the inferior opacification performance of Example 7-PA. Furthermore, the data of Table VI demonstrate that the quaternized alkanolamine fatty acid esters prepared from various unsaturated, linear fatty acids are more effective at improving the opacity and scattering coefficient of paper than those prepared from saturated linear fatty acids. Finally, the comparisons made in this study reveal that that within stated TAPPI reproducibility limits there was little or no impact on the resulting sheets's bulk value despite the gains in sheet opacity realized from adding the diester quat additives. This strongly suggests that the quaternized alkanolamine fatty acid esters of this invention do not provide opacification through conventional debonding means as fiber debonding would have been reflected in increased bulking of the test sheets versus the control sheet.

Test 7

This application study utilized a newsprint stock obtained from the Southeastern US to comparatively evaluate resultant opacity versus bulk values. The stock was composed of 70% hydrosulfite bleached thermomechanical pulp (TMP) and 30% deinked recycled newsprint pulp. The stock had a pH of about 6.5-6.7 and the resulting test sheet grammage was 61.5 g/square meter. The dosage of the opacification additive as per Table VII is given in active pounds of additive per bone dry ton of slurry solids (lb/t of quaternized alkanolamine fatty acid ester).

TABLE VII

| Opacification Treatment | TAPPI Opacity (%) | Delta Opacity (% Pts) | Scattering Coefficient ($m^2$/kg) | Bulk (cm3/g) |
|---|---|---|---|---|
| Control | 91.8 | — | 53.1 | 2.86 |
| 15 lb/t Ex. 3-INV | 93.3 | 1.6 | 58.6 | 2.89 |
| 15 lb/t Ex. 7-PA | 92.8 | 1.0 | 56.4 | 2.86 |
| 15 lb/t Ex. 19-INV | 93.6 | 1.9 | 58.0 | 2.88 |
| 15 lb/t Ex. 20-INV | 93.1 | 1.4 | 56.3 | 2.90 |
| 15 lb/t Ex. 21-INV | 93.1 | 1.4 | 56.4 | 2.89 |
| 15 lb/t Ex. 18-INV (sat.) | 92.6 | 0.9 | 56.2 | 2.97 |
| 15 lb/t Ex. 22-INV | 92.4 | 0.7 | 53.8 | 2.97 |
| 15 lb/t Ex. 23-INV (branched) | 93.5 | 1.8 | 58.0 | 2.88 |

The results in Table VII demonstrate that all of the quaternized alkanolamine fatty acid esters of this invention, when used as wet-end additives, improve the opacity and scattering coefficient of paper and that within stated TAPPI reproducibility there was little or no impact on the resulting sheet's bulk value.

Table VII also shows that unsaturated and/or branched fatty acids can be effectively used to produce the quaternized alkonolamine fatty acid ester compounds of this invention and that these compounds generally result in further improved opacity and scattering coefficient of the paper, and generally, these diester quats have little to no effect on the resulting sheet's bulk value. The opacification data of Table VII also show that the branched or unsaturated fatty acid types are preferred over saturated types of starting fatty acids and those containing higher carbon chain length levels such as the $C_{22}$ derivative of Ex. 22-INV. The above facts once again strongly suggest that the quaternized alkanolamine fatty acid esters of this invention do not provide opacification through conventional debonding means as fiber debonding would have been reflected in increased bulking of the test sheets versus the control sheet.

Test 8

This application study utilized a blend of 40% bleached Kraft pulp from southern pine and 60% bleached Kraft pulp from hardwood with a CSF of 330 ml and investigated the effect of increasing the wet-end addition levels of two different diester quat compounds, namely 3-INV and 19-INV, as the opacification aid. The stock had a pH of about 7.8-8.0 and the resulting test sheet grammage was 65.0 g/square meter. The dosage of the opacification additive as per Table VIII is given in active pounds of additive per bone dry ton of slurry solids (lb/t of quaternized alkanolamine fatty acid ester). The Kraft stock used in preparing the test sheets also contained 16 lb/t of cationic starch (Stalok 400) and 3.4 lb/t of cationic flocculant (Kemira R9820)

TABLE VIII

| Opacification Treatment | TAPPI Opacity (%) | Delta Opacity (% Pts) |
|---|---|---|
| No additive (control) | 74.9 | — |
| 10 lb/t Example 1-PA | 75.0 | 0.1 |
| 2 lb/t Example 3-INV | 74.7 | −0.2 |
| 5 lb/t Example 3-INV | 77.7 | 2.8 |
| 10 lb/t Example 3-INV | 78.7 | 3.8 |
| 5 lb/t Example 19-INV | 77.3 | 2.4 |
| 10 lb/t Example 19-INV | 79.6 | 4.7 |

The data of Table VIII shows that while no opacity gain is observed for the prior art stearamide (Ex. 1-PA) and at a low addition level of Ex. 3-INV (e.g., 2 lbs/ton), there is an appreciable gain in sheet opacity with greater addition amounts of the Ex. 3-INV quaternized alkanolamine fatty acid esters. Interestingly, the largest gains in sheet opacity were obtained with 10 lb/t of the highly unsaturated fatty acid ester of example 19-INV.

Test 9

Figure 3:
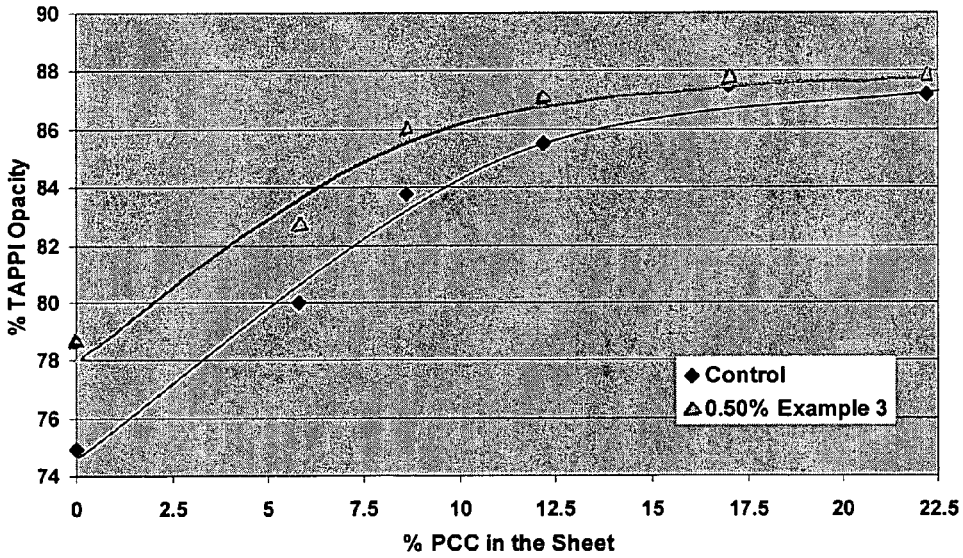
FIG. 3 is a graph showing the effect on opacity of PCC with or without a quaternized alkanolamine fatty acid ester compound.

This application study utilized a blend of 40% bleached Kraft pulp from southern pine and 60% bleached Kraft pulp from hardwood with a CSF of 330ml and investigated the effect on resultant sheet opacity that's derived from wet-end addition of the quaternized alkanolamine fatty acid ester compound (Ex. 3-INV) as compared to the opacity of an unfilled control sheet or of a sheet already containing a specific inorganic filler loading of precipitated calcium carbonate (PCC). The stock had a pH of about 7.8-8.0 and the resulting test sheet grammage was about 65.0 g/square meter. The dosage of the opacification additive Ex. 3-INV used in this study, as indicated in FIG. 3, was 0.50% by weight (which is the active weight % of the diester quat additive applied as based on the bone dry slurry solids). The Kraft stock used in preparing the test sheets also contained 16 lb/t of cationic starch (Stalok 400) and 3.4 lb/t of cationic flocculant (Kemira R9820), and various amounts of precipitated calcium carbonate (from Specialty Minerals, Inc.) as an inorganic filler. The results of this test program are depicted in FIG. 3, wherein the sheet opacity is plotted versus the amount of PCC filler used alone (no diester quat added), and also the PCC loading when combined with the quaternized alkanolamine fatty acid ester compound of Example 3-INV at a wet-end addition level of 0.50% by weight (as based on the bone dry slurry solids). It should be noted that a 0.5% by weight addition for the opacification aid is equivalent to 10 lb/t when its wet-end addition is expressed in terms of active pounds of additive used per bone dry ton of slurry solids.

This example clearly demonstrates that in a fine paper furnish containing PCC filler, that equivalent opacity can be obtained by using lower filler loadings in the sheet when the quaternized alkanolamine fatty acid esters of this invention are utilized in combination with these lower PCC loadings to treat the stock. For example, adding 0.5% by weight (10 lb/t) of the quaternized alkanolamine fatty acid ester compound of Example 3-INV to a Kraft furnish containing approximately 8% PCC filler results in an opacity increase of 2.0% units. Stated another way, the opacity yielding PCC filler was substituted with the diester quat additives of this invention while maintaining opacity targets for the final sheet at a 7% PCC filler level when the sheet grammage of the test sheets were maintained about 65 g/square meter. That is, to obtain the same sheet opacity of an 8% PCC containing furnish, one only has to employ 0.5% by weight of quaternized alkanolamine fatty acid ester compound and approximately 7.0% PCC filler given a sheet grammage target of 65 g/square meter.

Within the scope of this same application study on Kraft pulp, some additional experiments in analogy to the above papermaking conditions were conducted wherein the loading of PCC filler was varied from 5.8% to 12.2% and the final sheet grammage for test sheets was also allowed to vary within the range of 60 to 70 g/square meter that contained either no opacification aid (the quaternized alkanolamine fatty acid ester compound Ex. 3-INV) or 10 lb/t of the opacification aid in combination with the PCC filler. These experimental variations were of interest to demonstrate the ability of the opacification aid to not only potentially replace PCC filler while maintaining the desired opacity but to also enable the formation of a lower grammage (basis weight) sheet of equivalent opacity. The comparative testing results on select test sheets of different grammage are presented in Table IX.

TABLE IX

| Test Sheet ID | Sheet Grammage, g/m$^2$ | PCC Filler Loading, % | Additive Level of Ex. 3-INV, lb/t | Sheet Opacity, % |
|---|---|---|---|---|
| A | 65 | 12.2 | 0 | 86.2 |
| B | 66 | 8.6 | 0 | 85.7 |
| C | 60 | 8.6 | 10 | 86.0 |

The data of Table IX clearly demonstrate that the 12.2% PCC filler loading of a 65 g/square meter grammage sheet can be reduced to a 60 g/square meter grammage sheet containing only 8.6% of PCC filler while still maintaining essentially equivalent opacity performance by adding only 10 lb/t of the diester quat opacification aid into the lower grammage sheet. Furthermore, a comparison of test sheets B and C in Table IX indicates that a constant PCC filler loading of 8.6% that sheet grammage can be reduced from 66 to 60 g/square meter by adding only 10 lb/t of the diester quat opacification aid. To reduce the grammage in this case, both PCC filler and fiber were proportionally removed in favor of a small additive amount of the opacification aid.

In some further handsheet experiments, it was also determined that not only can opacification properties be maintained by replacing PCC filler with the quaternized alkanolamine fatty acid ester compound Ex. 3-INV, and concurrently yield lower grammage sheets, but that the resultant sheet strength properties (as measured by tensile) can often be maintained as well. This relationship between sheet grammage, PCC filler loading, sheet opacity and tensile strength as a function of utilizing the diester quat opacification aid of this invention as a wet-end additive is demonstrated in comparing the properties of test sheets D and E in Table X. Test sheets D and E provide essentially equivalent opacity and tensile strength performance as both values are within the precision of the measurements being made. This data therefore confirms once again the generally non-deleterious nature of the diester quat compound on paper mechanical properties when it is utilized as a wet-end additive for opacification.

TABLE X

| Test Sheet ID | Sheet Grammage, g/m$^2$ | PCC Filler Loading, % | Additive Level of Ex. 3-INV, lb/t | Sheet Opacity, % | Tensile, N · m/g |
|---|---|---|---|---|---|
| D | 69.5 | 12.2 | 0 | 88.1 | 27.5 |
| E | 68 | 8.6 | 10 | 87.9 | 28.9 |

Test 10

Figure 4:
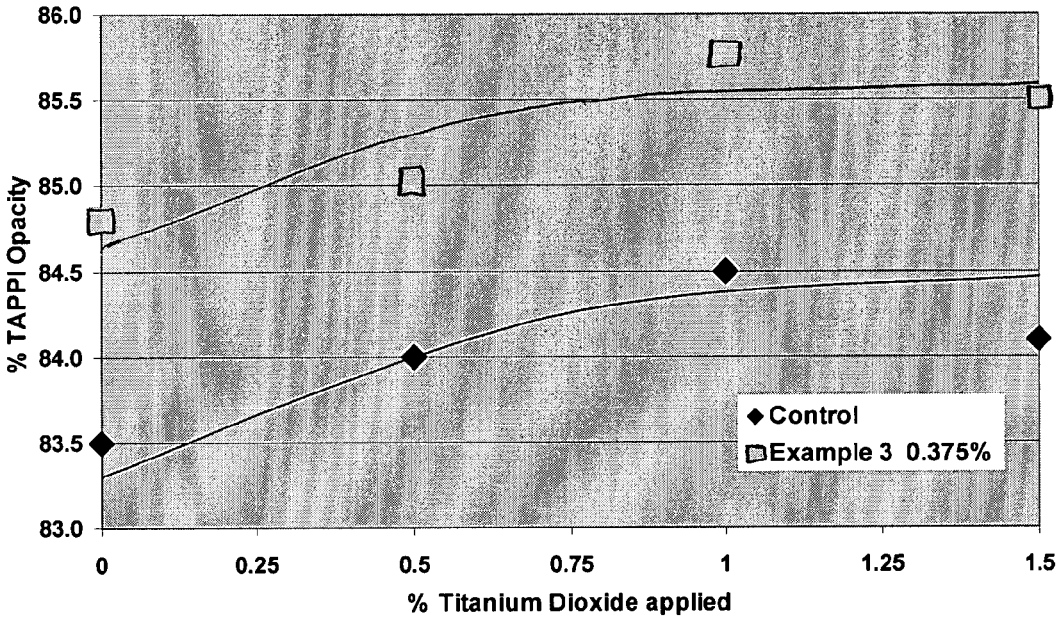
FIG. 4 is a graph showing the effect on opacity of titanium dioxide with or without a quaternized alkanolamine fatty acid ester compound.

This application study was performed to show that in using a quaternized alkanolamine fatty acid ester compound, as a wet-end opacification aid, that lower loadings of titanium dioxide pigment can be realized without a loss in sheet opacity. The testing utilized a blend of 29% bleached Kraft pulp from southern pine, 47% bleached Kraft pulp from hardwood, and 24% coated broke. The stock had a pH of about 7.8-8.0 and the resulting test sheet grammage was about 60 g/square meter. The dosage of the opacification additive Ex. 3-INV used in this study, as indicated in FIG. 4, was 0.375% by weight (which is the active weight % of the diester quat additive applied as based on the bone dry slurry solids). The Kraft stock used in preparing the test sheets also contained 14 lb/t of cationic starch, 5 lb/t of cationic coagulant, 0.5 lb/t cationic flocculant, 1.8 lb/t colloidal silica, 65 lb/t of precipitated calcium carbonate filler, and various levels of rutile titanium dioxide pigment. The application results of Test 10 are shown in FIG. 4, wherein opacity is plotted as a function of the titanium dioxide pigment loading. The effect of including 0.375% by weight of a quaternized alkanolamine fatty acid ester compound (7.5 lb/t) on resultant sheet opacity is shown by comparing the respective opacity curves defined by the sheets containing only titanium dioxide pigment versus that defined by the sheets containing a combination of titanium dioxide and 0.375% of the opacification aid.

This application study demonstrates that in a fine paper furnish containing a combination of precipitated calcium carbonate filler and titanium dioxide pigment that equivalent sheet opacity can still be obtained at lower titanium dioxide pigment loadings (PCC held constant) in the sheet when the quaternized alkanolamine fatty acid esters of this invention are used to treat the stock. Stated another way the opacity yielding titanium dioxide pigment was substituted with the opacification additives of this invention while maintaining opacity targets for the final sheet. From an opacity standpoint, the comparative opacity curves of FIG. 4 clearly suggest that about 1% by weight of titanium dioxide pigment can be replaced with about 0.375% by weight of the opacification aid when maintaining the sheet grammage of the test sheets at 60 g/square meter.

Test 11

This application study was conducted to demonstrate that the use of the quaternized alkanolamine fatty acid ester compounds of this invention, such as Ex. 3-INV, do not adversely affect other important characteristics of the paper such as brightness or mechanical properties. The testing utilized a blend of 29% bleached Kraft pulp from southern pine, 47% bleached Kraft pulp from hardwood, and 24% coated broke. The stock had a pH of about 7.8-8.0 and the resulting test sheet grammage was about 80 g/square meter. The dosage of the opacification additive as per Table XI is given in active pounds of additive per bone dry ton of slurry solids (lb/t of the quaternized alkanolamine fatty acid ester previously referred to as Ex. 3-INV).

The stock used in preparing the test sheets also contained 14 lb/t of cationic starch, 5 lb/t of cationic coagulant, 0.5 lb/t cationic flocculent, 1.8 lb/t colloidal silica, 65 lb/t of precipitated calcium carbonate filler, and also rutile titanium dioxide pigment at a loading of 20 lb/ton. The paper testing results in terms of opacity, brightness, tensile, tear, burst and bulk are presented in Table XI.

TABLE XI

| Opacification Treatment | TAPPI Opacity (%) | Tensile Index (N · m/g) w/±St.Dev. | Tear Index (mN · $m^2$/g) | Burst Index (kPa · $m^2$/g) w/±St.Dev | Bulk ($cm^3$/g) | Brightness (% ISO) |
|---|---|---|---|---|---|---|
| No additive (control) | 87.8 | 39.7 ± 2.7 | 10.0 | 4.7 ± 0.2 | 1.22 | 84.8 |
| 7.5 lb/ton Example 3-INV | 89.5 | 38.5 ± 2.3 | 9.5 | 4.1 ± 0.4 | 1.24 | 85.2 |

The data of Table XI demonstrate that the addition of the quaternized alkanolamide fatty acid esters, such as Example 3-INV, are able to increase opacity significantly while having essentially no deleterious effects on tensile index, tear index, bulk, or sheet brightness relative to the control containing no opacification additive.

Test 12

This application study was designed to investigate the effect of calendering on sheet opacity when using the quaternized alkanolamine fatty acid ester compounds of this invention as a wet-end additive. The test utilized a blend of 29% bleached Kraft pulp from southern pine, 47% bleached Kraft pulp from hardwood, and 24% coated broke. The stock had a pH of about 7.8-8.0 and the resulting test sheet grammage was 80 g/square meter. The dosage of the opacification additive as per Table XII is given in active pounds of additive per bone dry ton of slurry solids (lb/t of the quaternized alkanolamine fatty acid ester previously referred to as Ex. 3-INV). The stock used in preparing the test sheets also contained 14 lb/t of cationic starch, 5 lb/t of cationic coagulant, 0.5 lb/t cationic flocculant, 1.8 lb/t colloidal silica, 65 lb/t of precipitated calcium carbonate filler, and rutile titanium dioxide pigment at loading of 20 lb/t. Following handsheet preparation the test sheets underwent one-pass calendering at 350° F. and 400 pounds/linear inch (PLI). The properties of the test sheets after one-pass calendering are presented in Table XII.

TABLE XII

| Opacification Treatment | Calendered TAPPI Opacity (%) | Delta Opacity (% Pts) | Calendered Bulk ($cm^3$/g) |
|---|---|---|---|
| No additive (control) | 86.9 | — | 0.55 |
| 7.5 lb/ton Example 3-INV | 88.3 | 1.4 | 0.54 |

The calendered sheets demonstrate reduced bulk which is to be expected; however, the opacity of the calendered sheet containing 7.5 lb/ton of Example 3-INV as a wet-end additive still clearly shows increased opacity versus the control sheet containing no additive. The ability to maintain such an opacity advantage after calendering with the use of an organic additive is unexpected in relation to the use of traditional debonder chemistries or chemically structured pigments as wet-end additives as the air micro-voids they tend to incorporate into the sheet that increase the scattering of light are easily compressed and consequently lost after calendering. Consequently, it is clear that the opacification aids of this invention provide novel and unexpected benefits to calendered paper products.

Furthermore, in comparing the opacity and bulk properties of the original uncalendered sheet containing no opacification aid (data presented in Table XI) to those for the calendered test sheet containing 7.5 lb/ton of the opacification aid (as per Table XII), it is clear that through the use of the diester quat compounds of this invention that calendered, additive-containing paper products can be produced that have equivalent or even superior opacity to uncalendered, no additive containing paper products despite the loss in bulk caused by the calendering process. In summary, the control sheet with no additive had opacity values of 87.8% and 86.9% before and after calendaring, respectively. In comparison, the test sheet containing 7.5 lb/ton of opacification aid still had an opacity value of 88.3% after calendering which is higher than what the control sheet ever was before calendering. This feature, resulting from wet-end addition of the inventive opacification aid, provides the paper manufacturer a convenient means to produce calendered paper products having superior smoothness and printability properties while economically maintaining or even exceeding the virgin sheet's inherent opacity performance at pre-calendering levels.

Test 13

This application study utilized a newsprint stock obtained from the Southeastern US and testing was conducted to compare the relative wet-end bulking versus opacification performance of the quaternized alkanolamine fatty acid esters of this invention to other quaternary ammonium compounds well known in the prior art to function as softener/debonders. The diester quat employed in this study was the compound from Example 3-INV. The softener/debonder additive employed was an imidazolinium quaternary compound, CAS Registry No.#94944-77-1, which is commonly sold under the commercial tradenames Incrosoft™ CFI 90 (by Croda Industries) and Varisoft 3690 (by Witco/Degussa). Such imidazolinium quaternary compounds are, for example, well known to be used as softener/debonders in tissue products as previously disclosed in U.S. Pat. No. 5,730,839. The stock was composed of 70% hydrosulfite bleached thermomechanical pulp (TMP) and 30% deinked recycled newsprint pulp. The stock had a pH of 6.5-6.7 and the resulting test sheet grammage was 61.0 g/square meter. For both wet-end additives, the dosage used for the comparative evaluations, as per Table XIII, was 10 lb/t which is expressed in active pounds of additive per bone dry ton of slurry solids.

As such, an invention has been disclosed in terms of preferred embodiments thereof, which fulfill each and every one of the objects of the present invention as set forth above and provides a new and improved method for controlling the optical properties when making opacity relevant grades of paper or paperboard products by using effective amounts of quaternized alkanolamine fatty acid ester compounds with the papermaking slurry and/or as components making up the slurry, and an improved opacity relevant grade of paper or paperboard product made therefrom such as, but not limited to, a communication type paper used in printing and writing applications.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An opacity relevant paper or paperboard product containing an effective amount of one or more quaternized dialkanolamine fatty acid ester compounds of the following structure:

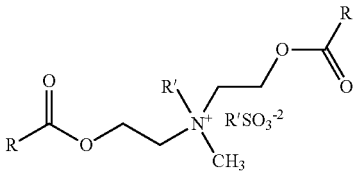

wherein R' is $C_2H_5$ and R is $C_{17}H_{35}$, and optionally, one or more additives, for control of at least optical properties in the opacity relevant paper or paperboard product, wherein the opacity is improved by at least 1.8% over paper or paperboard product containing no quaternized dialkanolamine fatty acid ester.

2. The paper product of claim 1, wherein the effective amount of the one or more quaternized dialkanolamine fatty acid ester compounds further comprises up to 100 pounds per ton of bone dry solids of a papermaking slurry utilized to make the opacity relevant paper or paperboard product.

3. The paper product of claim 2, wherein the effective amount of the one or more quaternized dialkanolamine fatty acid ester compounds further comprises up to 25 pounds per ton of bone dry solids of a papermaking slurry.

4. The paper product of claim 1, wherein the opacity relevant paper or paperboard product further comprises one or more of printing & writing grades, newsprint, magazine grades, fine paper grades, coated and/or uncoated book grades, directory grades, bond grades, bible grades, bristol grades, offset printing grades, supercalender grades, mailers, envelopes, advertising supplements, whitetop linerboards, index cards, printing boards, cover sheets for tables, computer cards, surgical gowns, and specialty writing stock.

5. The paper product of claim 1, further consisting of one or more additives selected from the group consisting of acids, bases, alums, sodium aluminate, sizing agents, dry strength additives, wet strength additives, fillers/pigments, retention aids, fiber defloculants, defoamers, drainage aids, optical brighteners, dyes, opacifiers, deposit control agents, and antimicrobial agents, or any mixture thereof.

6. The paper product of claim 5, wherein the fillers/pigments include kaolin clay, calcined clay, ground calcium carbonate, precipitated calcium carbonate, talc, alumina trihydrate, amorphous silica & metal silicates and titanium dioxide, or any mixture thereof.

7. The paper product of claim 5, wherein the opacity relevant paper or paperboard product is a calendered opacity relevant paper or paperboard product.

8. The paper product of claim 1, wherein the effective amount of the one or more quaternized dialkanolamine fatty acid ester compounds further comprises up to 25 pounds per ton of bone dry solids of a papermaking slurry.

* * * * *